US010831139B1

(12) United States Patent
Oshima et al.

(10) Patent No.: US 10,831,139 B1
(45) Date of Patent: Nov. 10, 2020

(54) IMAGE FORMING APPARATUS INCLUDING A FIXING BELT FOR FIXING TONER INCLUDING TONER PARTICLES AND SILICA PARTICLES

(71) Applicant: FUJI XEROX CO., LTD., Tokyo (JP)

(72) Inventors: Shota Oshima, Kanagawa (JP); Takafumi Koide, Kanagawa (JP); Makoto Kamisaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/838,238

(22) Filed: Apr. 2, 2020

(30) Foreign Application Priority Data

Sep. 25, 2019 (JP) ..... 2019-174593

(51) Int. Cl.
*G03G 15/08* (2006.01)
*G03G 15/20* (2006.01)

(52) U.S. Cl.
CPC ..... *G03G 15/2053* (2013.01); *G03G 15/2007* (2013.01); *G03G 2215/2032* (2013.01)

(58) Field of Classification Search
CPC ..... G03G 9/08797; G03G 9/0821; G03G 9/0827; G03G 15/2017; G03G 15/2053
USPC ..... 399/329
See application file for complete search history.

(56) References Cited

U.S. PATENT DOCUMENTS 7,203,453 B2 4/2007 Naito et al.
7,396,630 B2 * 7/2008 Watanabe et al. ..... G03G 9/08797 430/108.4
10,338,488 B2 * 7/2019 Igarashi et al. ..... G03G 9/0821
2010/0272471 A1 10/2010 Yang et al.

FOREIGN PATENT DOCUMENTS

| | | | |
|---|---|---|---|
| JP | 2002-023533 | A | 1/2002 |
| JP | 2002-099171 | A | 4/2002 |
| JP | 2006-047768 | A | 2/2006 |
| JP | 2011-507049 | A | 3/2011 |
| JP | 2019-020754 | A | 2/2019 |

* cited by examiner

*Primary Examiner* — William J Royer
(74) *Attorney, Agent, or Firm* — Sughrue Mion, PLLC

(57) ABSTRACT

An image forming apparatus includes an image holding member; a charging unit; an electrostatic image forming unit; a developing unit that includes an electrostatic image developer that includes a toner; a transfer unit; and a fixing unit that fixes the toner image transferred on the surface of the recording medium to the recording medium. The fixing unit includes a fixing belt arranged to contact with the toner image transferred on the surface of the recording medium, a rotatable body arranged to be in contact with an outer peripheral surface of the fixing belt so as to form a contact region between the rotatable body and the fixing belt, the rotatable body transporting the recording medium in the contact region by rotating together with the fixing belt, and a heat source that heats the contact region formed between the fixing belt and the rotatable body. The toner includes toner particles, and silica particles having a number average particle size of 110 nm to 130 nm, a large-diameter-side number particle size distribution index (upper GSDp) of less than 1.080, and an average circularity of 0.94 to 0.98, wherein 80 number % or more of the silica particles have a circularity of 0.92 or more.

20 Claims, 6 Drawing Sheets

IMAGE FORMING APPARATUS INCLUDING A FIXING BELT FOR FIXING TONER INCLUDING TONER PARTICLES AND SILICA PARTICLES

CROSS-REFERENCE TO RELATED APPLICATIONS

This application is based on and claims priority under 35 USC 119 from Japanese Patent Application No. 2019-174593 filed Sep. 25, 2019.

BACKGROUND

(i) Technical Field

The present disclosure relates to an image forming apparatus.

(ii) Related Art

Japanese Laid Open Patent Application Publication No. 2002-099171 discloses a fixing device that includes a first fixing roller, a rotation roller disposed at a predetermined distance from the first fixing roller, an endless belt rotatably wound on the first fixing roller and the rotation roller, and a second fixing roller arranged to be in pressure contact with the first fixing roller with the endless belt interposed between the first and second fixing rollers. The endless belt is caused to rotate by the driving force transmitted from the first fixing roller.

Japanese Laid Open Patent Application Publication No. 2006-047768 discloses a fixing device that includes an endless fixing belt arranged capable of revolving while the central portion of the fixing belt in the width direction is not subjected to a tensile force in the circumferential direction, a heating device that heats the fixing belt, a pressurizing roller that is contacted with the outer peripheral surface of the fixing belt and arranged rotatable around a shaft, a pressing member that is contacted with the inner peripheral surface of the fixing belt and applies a pressing force between the pressing member and the pressurizing roller with the fixing belt interposed therebetween, and a supporting member that is inserted into the space surrounded by the fixing belt and supports the pressing member. In the fixing device, an unfixed toner image formed on a recording medium that passes through a fusing nip part formed between the fixing belt and the pressurizing roller is pressurized and heated to form a fixed image. The shape of the ends of the fixing belt is maintained to be circular in the circumferential direction. The fixing belt is supported by the supporting member so as to be rotatable around the central axis defined by the ends of the supporting member.

Japanese Laid Open Patent Application Publication (Translation of PCT Application) No. 2011-507049 discloses an electrophotographic toner that includes toner base particles that include a binder resin, a colorant, a release agent, and a charge controlling agent; and barium titanate external additive particles deposited on the surfaces of the toner base particles, the external additive particles having an average primary particle size of 50 to 150 nm, an average shape factor (SF1) of 100 to 120, a shape factor of 0.96 to 1, and an aspect ratio of 0.89 to 1.

SUMMARY

Image forming apparatuses that include an electrophotographic photosensitive member; an electrostatic image forming unit; a developing unit that includes an electrostatic image developer including an electrostatic image developing toner and develops an electrostatic image formed on a surface of the electrophotographic photosensitive member with the electrostatic image developer to form an electrostatic image developing toner image; a transfer unit; and a fixing unit that fixes the toner image transferred on the surface of a recording medium to the recording medium, the fixing unit including a fixing belt arranged to contact with the toner image transferred on the surface of the recording medium, a rotatable body arranged to be in contact with an outer peripheral surface of the fixing belt so as to form a contact region between the rotatable body and the fixing belt, the rotatable body transporting the recording medium in the contact region by rotating together with the fixing belt, and a heat source that heats the contact region formed between the fixing belt and the rotatable body (hereinafter, such image forming apparatuses are referred to as "the specific image forming apparatuses"), are known in the related art.

The low-temperature fixability of the specific image forming apparatuses may vary.

Aspects of non-limiting embodiments of the present disclosure relate to an image forming apparatus that may reduce the inconsistency in low-temperature fixability compared with the specific image forming apparatuses that include only silica particles having an average particle size of 110 nm or more and 130 nm or less and a large-diameter-side number particle size distribution index (upper GSDp) of 1.080 or more as external additive particles for the electrostatic image developing toner.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an image forming apparatus including an image holding member; a charging unit that charges a surface of the image holding member; an electrostatic image forming unit that forms an electrostatic image on the charged surface of the image holding member; a developing unit that includes an electrostatic image developer that includes a toner and develops the electrostatic image formed on the surface of the image holding member with the electrostatic image developer to form a toner image; a transfer unit that transfers the toner image onto a surface of a recording medium; and a fixing unit that fixes the toner image transferred on the surface of the recording medium to the recording medium. The fixing unit includes a fixing belt arranged to contact with the toner image transferred on the surface of the recording medium, a rotatable body arranged to be in contact with an outer peripheral surface of the fixing belt so as to form a contact region between the rotatable body and the fixing belt, the rotatable body transporting the recording medium in the contact region by rotating together with the fixing belt, and a heat source that heats the contact region formed between the fixing belt and the rotatable body. The toner includes toner particles, and silica particles having a number average particle size of 110 nm to 130 nm, a large-diameter-side number particle size distribution index (upper GSDp) of less than 1.080, and an average circularity of 0.94 to 0.98, wherein 80 number % or more of the silica particles have a circularity of 0.92 or more.

BRIEF DESCRIPTION OF THE DRAWINGS

Exemplary embodiments of the present disclosure will be described in detail based on the following figures, wherein.

DETAILED DESCRIPTION

Figure 1:
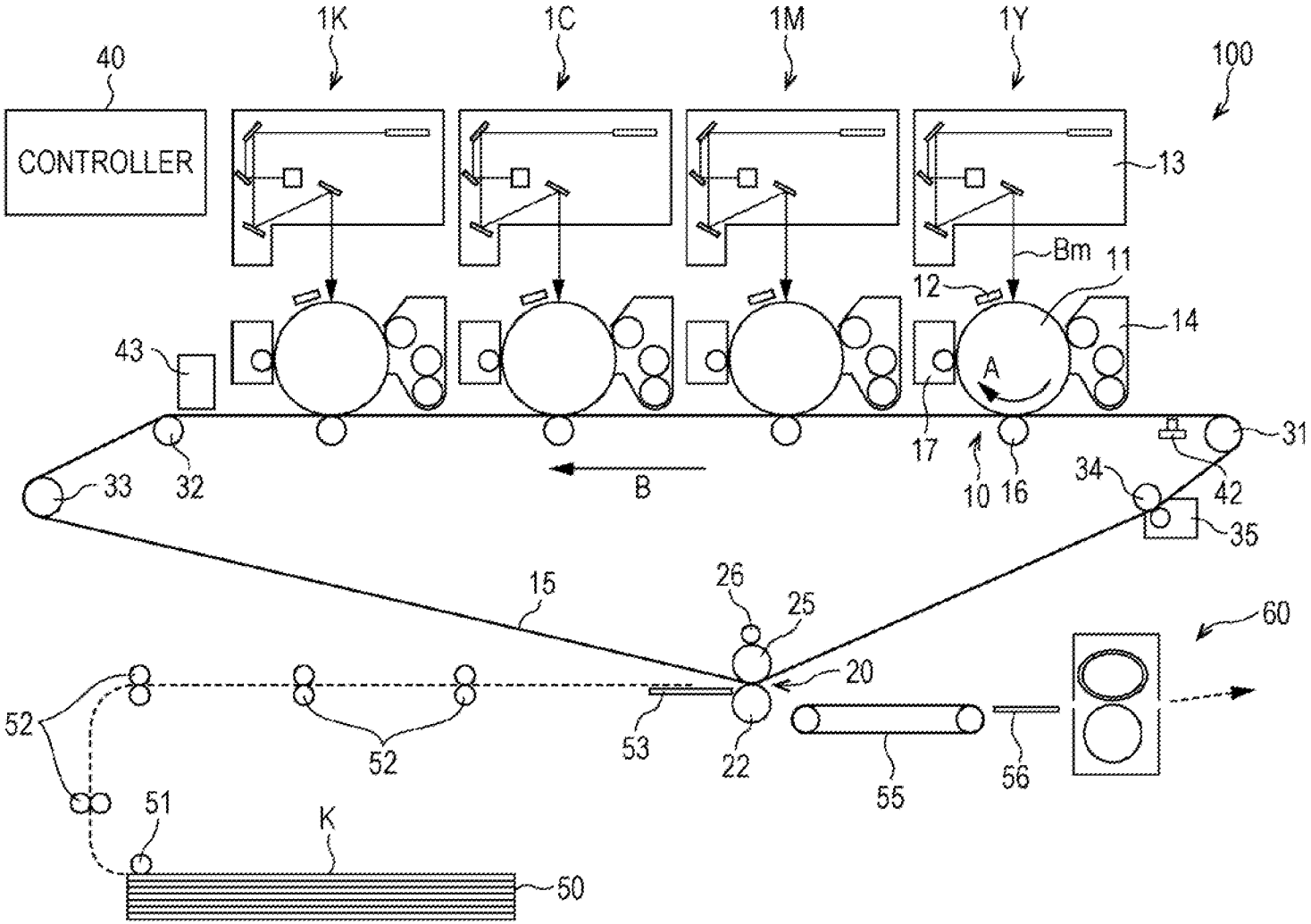
FIG. 1 is a schematic diagram illustrating an example of an image forming apparatus according to an exemplary embodiment.

An exemplary embodiment of the present disclosure is described below. The following description and Examples below are intended to be illustrative of the exemplary embodiment and not restrictive of the scope of the exemplary embodiment.

In the present disclosure, when numerical ranges are described in a stepwise manner, the upper or lower limit of a numerical range may be replaced with the upper or lower limit of another numerical range, respectively. In the present disclosure, the upper and lower limits of a numerical range may be replaced with the upper and lower limits described in Examples below.

Each of the components described in the present disclosure may include plural types of substances that correspond to the component. In the present disclosure, in the case where a composition includes plural substances that correspond to a component of the composition, the content of the component in the composition is the total content of the plural substances in the composition unless otherwise specified.

Image Forming Apparatus

An image forming apparatus according to the exemplary embodiment includes an electrophotographic photosensitive member including a photosensitive layer; an electrostatic image forming unit that forms an electrostatic image on a charged surface of the electrophotographic photosensitive member; a developing unit that includes an electrostatic image developer that includes an electrostatic image developing toner and develops the electrostatic image formed on the surface of the electrophotographic photosensitive member with the electrostatic image developer to form a toner image; a transfer unit that transfers the toner image formed on the surface of the electrophotographic photosensitive member onto a surface of a recording medium; and a fixing unit that fixes the toner image transferred on the surface of the recording medium to the recording medium.

The fixing unit includes a fixing belt arranged to contact with the toner image transferred on the surface of the recording medium, a rotatable body arranged to be in contact with an outer peripheral surface of the fixing belt so as to form a contact region between the rotatable body and the fixing belt, the rotatable body transporting the recording medium in the contact region by rotating together with the fixing belt, and a heat source that heats the contact region formed between the fixing belt and the rotatable body.

The above-described electrostatic image developing toner includes toner particles and silica particles having a number average particle size of 110 nm or more and 130 nm or less, a large-diameter-side number particle size distribution index (upper GSDp) of less than 1.080, and an average circularity of 0.94 or more and 0.98 or less, wherein 80 number % or more of the silica particles have a circularity of 0.92 or more.

Hereinafter, the image forming apparatus according to the exemplary embodiment may be referred to as "the specific image forming apparatus".

Silica particles having the above-described properties may be referred to as "first silica particles".

An electrophotographic photosensitive member may be referred to simply as "photosensitive member".

An electrostatic image developing toner may be referred to simply as "toner".

Image forming apparatuses that include a fixing unit, the fixing unit including a fixing belt arranged to contact with a toner image transferred on the surface of a recording medium, a rotatable body arranged to be in contact with an outer peripheral surface of the fixing belt so as to form a contact region between the rotatable body and the fixing belt, the rotatable body transporting the recording medium in the contact region by rotating together with the fixing belt, and a heat source that heats the contact region formed between the fixing belt and the rotatable body, as with the above-described specific image forming apparatus, are known in the related art. Since the specific image forming apparatus includes a heat source that heats the contact region, the specific image forming apparatus is capable of quickly increasing the fusing temperature while saving power consumption and fixing a toner image at low temperatures.

However, the low-temperature fixability of the specific image forming apparatus may vary by the properties of the toner included in the image forming apparatus. The reasons are not clear but presumably as follows.

Image forming apparatuses include a toner that includes toner particles and silica particles serving as external additive particles in order to assist cleaning and enhance fixability.

In the specific image forming apparatuses known in the related art, if silica particles having large diameters or odd shapes are deposited on the surfaces of the toner particles, the transfer of heat energy from the heat source to the toner particles in the fixing step is likely to be blocked. On the other hand, in the specific image forming apparatuses known in the related art, if small-diameter or spherical silica particles are deposited on the surfaces of the toner particles, the small-diameter silica particles may roll on the surfaces of the toner particles to form aggregates and, consequently, the function of the silica particles as external additive particles may become degraded. This may result in the inconsistency in low-temperature fixability.

In contrast, the image forming apparatus according to the exemplary embodiment includes a toner including the first silica particles that have the above-described properties and are deposited on the surfaces of the toner particles.

The first silica particles have a number average particle size of 130 nm or less, a large-diameter-side number particle size distribution index (upper GSDp) of less than 1.080, and an average circularity of 0.94 or more. Furthermore, 80 number % or more of the silica particles have a circularity of 0.92 or more. In other words, the first silica particles are silica particles having adequate particle sizes. Moreover, the proportion of large-diameter and odd-shaped particles is low. Accordingly, even when the first silica particles are deposited on the surfaces of toner particles, the transfer of heat energy from the heat source to the toner particles in the fixing step is not likely to be blocked. The first silica particles have a number average particle size of 110 nm or more and an average circularity of 0.98 or less. In other words, the first silica particles are silica particles having adequate particle sizes. In addition, the proportion of small-diameter and spherical particles is low. Accordingly, even when the first silica particles are deposited on the surfaces of toner particles, the small-diameter silica particles are not likely to roll on the surfaces of the toner particles to form aggregates. This may reduce the inconsistency in low-temperature fixability even in the specific image forming apparatus.

Specific Examples of Image Forming Apparatus

The image forming apparatus according to the exemplary embodiment may be any image forming apparatus known in the related art, such as a direct-transfer image forming apparatus in which a toner image formed on the surface of an electrophotographic photosensitive member is directly transferred to a recording medium; an intermediate-transfer image forming apparatus in which a toner image formed on the surface of an electrophotographic photosensitive member is transferred onto the surface of an intermediate transfer body in a first transfer step and the toner image transferred on the surface of the intermediate transfer body is transferred onto the surface of a recording medium in a second transfer step; and an image forming apparatus including an erasing unit that erases static by irradiating the surface of an electrophotographic photosensitive member with erasing light subsequent to the transfer of the toner image before the electrophotographic photosensitive member is again charged.

In the case where the image forming apparatus according to the exemplary embodiment is an image forming apparatus using the intermediate transfer system, the transfer unit may be constituted by, for example, an intermediate transfer body to which a toner image is transferred, a first transfer subunit that transfers a toner image formed on the surface of the electrophotographic photosensitive member onto the surface of the intermediate transfer body in the first transfer step, and a second transfer subunit that transfers the toner image transferred on the surface of the intermediate transfer body onto the surface of a recording medium in the second transfer step.

In the image forming apparatus according to the exemplary embodiment, for example, a portion including at least the electrophotographic photosensitive member may have a cartridge structure (i.e., process cartridge) detachably attachable to the image forming apparatus.

The image forming apparatus according to the exemplary embodiment is described below with reference to the attached drawing.

FIG. 1 is a schematic diagram illustrating an example of the image forming apparatus according to the exemplary embodiment.

An image forming apparatus 100 according to the exemplary embodiment is, for example, an intermediate-transfer image forming apparatus illustrated in FIG. 1, which is commonly referred to as a tandem image forming apparatus. The image forming apparatus 100 includes a plurality of image formation units 1Y, 1M, 1C, and 1K that form yellow (Y), magenta (M), cyan (C), and black (K) toner images by an electrophotographic system; a first transfer section 10 in which the yellow, magenta, cyan, and black toner images formed by the image formation units 1Y, 1M, 1C, and 1K are sequentially transferred (first transfer) to an intermediate transfer belt 15; a second transfer section 20 in which the superimposed toner images transferred on the intermediate transfer belt 15 are collectively transferred (second transfer) to a paper sheet K, which is a recording medium; and a fixing device 60 (an example of the fixing unit) that fixes the image transferred on the paper sheet K by second transfer to the paper sheet K. The image forming apparatus 100 also includes a controller 40 that receives and sends information from and to each device (i.e., each unit) to control the operation of the device (i.e., the unit).

The unit that includes the intermediate transfer belt 15, the first transfer section 10, and the second transfer section 20 corresponds to an example of the transfer unit.

Each of the image formation units 1Y, 1M, 1C, and 1K included in the image forming apparatus 100 includes a photosensitive member 11 that rotates in the direction of the arrow A, which is an example of the electrophotographic photosensitive member that holds a toner image formed on the surface.

The photosensitive member 11 is provided with a charger 12 and a laser exposure machine 13 disposed on the periphery of the photosensitive member 11. The charger 12 (an example of a charging unit) charges the photosensitive member 11. The laser exposure machine 13 (an example of an electrostatic image forming unit) writes an electrostatic image on the photosensitive member 11 (in FIG. 1, an exposure beam is denoted with Bm).

The photosensitive member 11 is also provided with a developing machine 14 and a first-transfer roller 16 disposed on the periphery of the photosensitive member 11. The developing machine 14 (an example of a developing unit) includes a yellow, magenta, cyan, or black toner and visualizes the electrostatic image formed on the photosensitive member 11 with the toner. The first-transfer roller 16 transfers the yellow, magenta, cyan, or black toner image formed on the photosensitive member 11 to the intermediate transfer belt 15 in the first transfer section 10.

At least one of the yellow, magenta, cyan, black toners is the specific toner described above. In the exemplary embodiment, all of the yellow, magenta, cyan, black toners may be the specific toner described above.

The photosensitive member 11 is further provided with a photosensitive member cleaner 17 disposed on the periphery of the photosensitive member 11. The photosensitive member cleaner 17 removes toner particles remaining on the photosensitive member 11. The above-described electrophotographic devices, that is, the charger 12, the laser exposure machine 13, the developing machine 14, the first-transfer roller 16, and photosensitive member cleaner 17, are sequentially arranged on the periphery of the photosensitive member 11 in the direction of the rotation of the photosensitive member 11. The image formation units 1Y, 1M, 1C, and 1K are arranged in a substantially linear manner in the order of yellow (Y), magenta (M), cyan (C), and black (K) in the direction of the rotation of the intermediate transfer belt 15.

The intermediate transfer belt 15 is driven in a circulatory manner (i.e., rotated), by various types of rollers at an intended speed in the direction of the arrow B illustrated in FIG. 1. The various types of rollers include a driving roller 31 that is driven by a motor (not illustrated) and rotates the intermediate transfer belt 15; a support roller 32 that supports the intermediate transfer belt 15 that extends in a substantially linear manner in the direction in which the photosensitive members 11 are arranged; a tension roller 33 that applies tension to the intermediate transfer belt 15 and serves as a correction roller that reduces meandering of the intermediate transfer belt 15; a backing roller 25 disposed in the second transfer section 20; and a cleaning backing roller 34 disposed on a cleaning section in which toner particles remaining on the intermediate transfer belt 15 are scraped off.

The first transfer section 10 is constituted by first-transfer rollers 16 that are arranged to face the respective photosensitive members 11 across the intermediate transfer belt 15 and serve as opposite members. Each of the first transfer rollers 16 is constituted by a core and a sponge layer that is firmly attached onto the periphery of the core and serves as an elastic layer. The core is a solid-cylindrical rod composed of a metal, such as iron or SUS. The sponge layer is a hollow-cylindrical spongious roller that is composed of an NBR/SBR/EPDM blend rubber including a conductant agent, such as carbon black, and has a volume resistivity of $10^{7.5}$ Ωcm or more and $10^{8.5}$ Ωcm or less.

The first-transfer rollers 16 are arranged to be in pressure contact with the photosensitive members 11 with the intermediate transfer belt 15 interposed between the first-transfer rollers 16 and the photosensitive members 11. The first-transfer rollers 16 are supplied with a voltage (first transfer bias) having a polarity opposite to the polarity (negative; the same applies hereinafter) of charged toner particles. Accordingly, toner images formed on the photosensitive members 11 are electrostatically attracted to the intermediate transfer belt 15 sequentially to form superimposed toner images on the intermediate transfer belt 15.

The second transfer section 20 is constituted by the backing roller 25 and a second transfer roller 22 disposed on a side of the intermediate transfer belt 15 on which the toner image is held.

The backing roller 25 is constituted by a surface layer that is a tube composed of an EPDM/NBR blend rubber in which carbon particles are dispersed and the inside part composed of an EPDM rubber. The backing roller 25 has a surface resistivity of $10^7$ Ω/sq or more and $10^{10}$ Ω/sq or less. The degree of hardness of the backing roller 25 is set to, for example, 70° ("ASKER C" produced by KOBUNSHI KEIKI CO., LTD.; the same applies hereinafter). The backing roller 25 is disposed on the rear surface-side of the intermediate transfer belt 15 and serves as a counter electrode for the second transfer roller 22. The backing roller 25 is provided with a power supplying roller 26 made of a metal, through which a second transfer bias is applied in a consistent manner.

The second transfer roller 22 is constituted by a core and a sponge layer that is firmly attached onto the periphery of the core and serves as an elastic layer. The core is a solid-cylindrical rod composed of a metal, such as iron or SUS. The sponge layer is a hollow-cylindrical spongious roller that is composed of an NBR/SBR/EPDM blend rubber including a conductant agent, such as carbon black, and has a volume resistivity of $10^{7.5}$ Ωcm or more and $10^{8.5}$ Ωcm or less.

The second transfer roller 22 is arranged to be in pressure contact with the backing roller 25 with the intermediate transfer belt 15 interposed between the second transfer roller 22 and the backing roller 25. The second transfer roller 22 is grounded. A second transfer bias is formed between the second transfer roller 22 and the backing roller 25. Consequently, the toner image is transferred (second transfer) to a paper sheet K (an example of the recording medium) transported to the second transfer section 20.

An intermediate transfer belt cleaner 35 is disposed on the intermediate transfer belt 15 at a position downstream of the second transfer section 20 such that the distance between the intermediate transfer belt cleaner 35 and the intermediate transfer belt 15 can be changed. The intermediate transfer belt cleaner 35 removes toner particles and paper dust particles that remain on the intermediate transfer belt 15 subsequent to the second transfer and cleans the surface of the intermediate transfer belt 15.

The intermediate transfer belt 15, the first transfer section 10 (i.e., the first-transfer rollers 16), and the second transfer section 20 (i.e., the second transfer roller 22) correspond to examples of the transfer unit.

A reference sensor (home position sensor) 42 is disposed upstream of the yellow image formation unit 1Y. The reference sensor (home position sensor) 42 generates a reference signal used as a reference to determine the timings at which images are formed in the image formation units 1Y, 1M, 1C, and 1K. An image density sensor 43 is disposed downstream of the black image formation unit 1K. The image density sensor 43 is used for adjusting image quality. The reference sensor 42 generates the reference signal upon recognizing a mark disposed on the back side of the intermediate transfer belt 15. Upon recognizing the reference signal, the controller 40 sends a command to the image formation units 1Y, 1M, 1C, and 1K. Each of the image formation units 1Y, 1M, 1C, and 1K starts forming an image in accordance with the command.

The image forming apparatus 100 according to the exemplary embodiment further includes the following components as units for transporting paper sheets K: a paper tray 50 that contains paper sheets K; a paper feed roller 51 that draws and transports a paper sheet K stocked in the paper tray 50 at predetermined timings; transport rollers 52 that transport the paper sheet K drawn by the paper feed roller 51; a transport guide 53 with which the paper sheet K transported by the transport rollers 52 is fed into the second transfer section 20; a transport belt 55 that transports the paper sheet K that has been subjected to the second transfer with the second transfer roller 22 to the fixing device 60 (an example of the fixing unit); and a fixing entrance guide 56 with which the paper sheet K is introduced into the fixing device 60.

The controller 40 is configured as a computer that controls the overall apparatus and performs various operations. Specifically, the controller 40 includes, for example, a central processing unit (CPU), a read-only memory (ROM) that stores various programs, a random access memory (RAM) used as a work area during the execution of a program, a nonvolatile memory that stores various types of information, and an input-output interface (I/O) (all not illustrated). The CPU, the ROM, the RAM, the nonvolatile memory, and the I/O are connected to one another with a bus.

The image forming apparatus 100 further includes, in addition to the controller 40, an operating display, an image processing unit, an image memory, a storage unit, a communication unit, etc. (all not illustrated). The operating display, the image processing unit, the image memory, the storage unit, and the communication unit are connected to the I/O of the controller 40. The controller 40 receives and sends information from and to the operating display, the image processing unit, the image memory, the storage unit, and the communication unit and controls these units.

A fundamental process for forming an image using the image forming apparatus 100 according to the exemplary embodiment is described below.

In image forming apparatus 100 according to the exemplary embodiment, image data sent from an image reading apparatus (not illustrated), a personal computer (PC, not illustrated), or the like are subjected to image processing using an image processing apparatus (not illustrated) and, subsequently, the image formation units 1Y, 1M, 1C, and 1K form images.

In the image processing apparatus, the input reflectance data are subjected to image processing that includes various types of image editing, such as shading correction, misalignment correction, lightness/color space conversion, gamma correction, frame removal, color editing, and image moving. The image data that have been subjected to the image processing are converted into yellow, magenta, cyan, and black colorant gradation data and sent to the laser exposure machines 13.

In accordance with the colorant gradation data received by each of the laser exposure machines 13, the laser exposure machine 13 irradiates the photosensitive member 11 included in each of the image formation units 1Y, 1M, 1C, and 1K with an exposure beam Bm emitted from a semiconductor laser or the like. After the surface of the photosensitive member 11 of each of the image formation units 1Y, 1M, 1C, and 1K has been charged by the charger 12, the surface of the photosensitive member 11 is scanned by the laser exposure machine 13 and exposed to the beam and, consequently, an electrostatic image is formed on the surface of the photosensitive member 11. The electrostatic image is developed in each of the image formation units 1Y, 1M, 1C, and 1K as Y, M, C, or K toner image.

The toner images formed on the photosensitive members 11 of the image formation units 1Y, 1M, 1C, and 1K are transferred to the intermediate transfer belt 15 in the first transfer section 10 in which the photosensitive members 11 contact with the intermediate transfer belt 15. Specifically, in the first transfer section 10, the first-transfer rollers 16 apply a voltage (first transfer bias) having a polarity opposite to the polarity (negative) of charged toner particles to the substrate of the intermediate transfer belt 15 and the toner images are sequentially superimposed on the surface of the intermediate transfer belt 15 (first transfer).

After the toner images have been sequentially transferred (first transfer) onto the surface of the intermediate transfer belt 15, the intermediate transfer belt 15 is moved and the toner images are transported to the second transfer section 20. When the toner images are transported to the second transfer section 20, in the transport unit, the paper feed roller 51 starts rotating and feeds a paper sheet K having an intended size from the paper tray 50 in synchronization with the transportation of the toner images to the second transfer section 20. The paper sheet K fed by the paper feed roller 51 is transported by the transport rollers 52 and reaches the second transfer section 20 through the transport guide 53. Before the paper sheet K reaches the second transfer section 20, the feeding of the paper sheet K is temporarily paused and an alignment between the paper sheet K and the toner images is made by an alignment roller (not illustrated) being rotated in synchronization with the movement of the intermediate transfer belt 15 on which the toner images are held.

In the second transfer section 20, the second transfer roller 22 is pressed by the backing roller 25 with the intermediate transfer belt 15 interposed between the second transfer roller 22 and the backing roller 25. The paper sheet K transported to the second transfer section 20 at the intended timing becomes inserted between the intermediate transfer belt 15 and the second transfer roller 22. Upon a voltage (second transfer bias) having a polarity that is the same as the polarity (negative) of charged toner particles being applied by the power supplying roller 26, a transfer electric field is generated between the second transfer roller 22 and the backing roller 25. The unfixed toner images held on the intermediate transfer belt 15 are electrostatically transferred to the paper sheet K collectively in the second transfer section 20, which is pressurized by the second transfer roller 22 and the backing roller 25.

The paper sheet K on which the toner images have been electrostatically transferred is subsequently removed from the intermediate transfer belt 15 and immediately transported by the second transfer roller 22 to the transport belt 55, which is disposed downstream of the second transfer roller 22 in the direction in which paper sheets are transported. The transport belt 55 transports the paper sheet K to the fixing device 60 in accordance with the transportation speed optimum for the fixing device 60. The unfixed toner images present on the paper sheet K transported to the fixing device 60 are fixed to the paper sheet K by heat and pressure in the fixing device 60. The paper sheet K on which the fixed image has been formed is transported to a paper eject tray (not illustrated) disposed in an ejecting section of the image forming apparatus 100.

Toner particles that remain on the intermediate transfer belt 15 after the termination of the transfer to the paper sheet K are transported to the cleaning section due to the rotation of the intermediate transfer belt 15 and removed from the intermediate transfer belt 15 by the cleaning backing roller 34 and the intermediate transfer belt cleaner 35.

Fixing Unit

The fixing unit may be any fixing unit that fixes a toner image transferred on the surface of a recording medium to the recording medium, the fixing unit including:

a fixing belt arranged to contact with the toner image transferred on the surface of the recording medium;

a rotatable body arranged to be in contact with an outer peripheral surface of the fixing belt so as to form a contact region between the rotatable body and the fixing belt, the rotatable body transporting the recording medium in the contact region by rotating together with the fixing belt; and a heat source that heats the contact region formed between the fixing belt and the rotatable body.

The fixing unit is described with reference to examples below; the fixing unit is not limited to the examples below.

Fixing Device According to First Exemplary Embodiment: DH1 Method

The fixing unit may further include a pressurizing member disposed on an inner peripheral surface of the fixing belt, the pressurizing member pressurizing the fixing belt in the contact region together with the rotatable body. Furthermore, the heat source may be a heat source that heats the contact region with the pressurizing member interposed between the heat source and the contact region. In other words, the fixing unit may be a "direct-heating" fixing unit.

Figure 2:
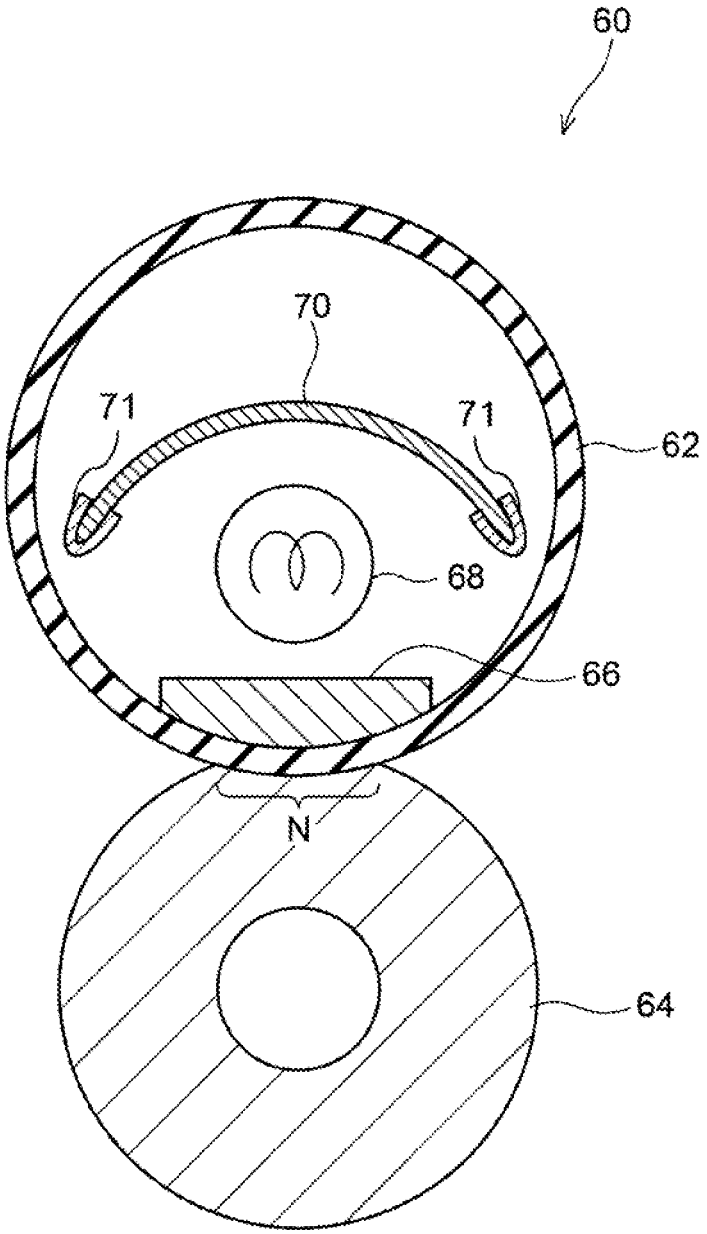
FIG. 2 is a schematic diagram illustrating an example of a fixing device according to a first exemplary embodiment.

FIG. 2 is a schematic diagram illustrating an example of a fixing device according to a first exemplary embodiment.

A fixing device 60 according to the first exemplary embodiment includes a fixing belt 62, a pressurizing roller 64 (an example of the rotatable body), a pressurizing pad 66 (an example of the pressurizing member), a halogen lamp 68 (an example of the heat source), a reflective plate 70 (an example of the reflective member), and a heat insulating member 71 as illustrated in FIG. 2.

The outer peripheral surfaces of the fixing belt 62 and the pressurizing roller 64 are in contact with each other to form a contact region N. The fixing belt 62 and the pressurizing roller 64 rotate together with each other to transport a paper sheet K in the contact region N.

The reflective plate 70 reflects heat emitted from the halogen lamp 68 toward the contact region N.

The heat insulating member 71 is interposed between an edge of the reflective plate 70 and a portion of the inner peripheral surface of the fixing belt 62, the portion of the inner peripheral surface facing the edge.

The fixing belt 62 is a belt arranged to contact with a toner image transferred on the surface of a paper sheet K. An example of the fixing belt 62 is an endless belt that includes a substrate (e.g., a polyimide resin substrate), an elastic layer (e.g., a silicone rubber layer), and a release layer (e.g., a fluororesin layer) stacked on top of one another in this order.

The thickness of the fixing belt 62 is, for example, 110 μm or more and 450 μm or less and is preferably 110 μm or more and 430 μm or less in order to reduce heat capacity.

The fixing belt 62 is rotatably supported by a bearing (not illustrated) at the ends of the fixing belt 62 in the axial direction. A driving force transmitting member (not illustrated), such as a gear, is inserted into one of the ends of the fixing belt 62 in the axial direction. The fixing belt 62 is caused to rotate upon the driving force transmitting member being rotated around the axis by a driving source (not illustrated), such as a motor.

The pressurizing roller 64 is arranged to be in contact with the outer peripheral surface of the fixing belt 62.

For example, the pressurizing roller 64 is composed of a resin or a metal and has a hollow or solid cylindrical shape. In a part of the outer peripheral surface of the pressurizing roller 64, a bearing member (not illustrated) is pressed by an elastic member, such as a spring, against the pressurizing pad 66 with the fixing belt 62 interposed between the pressurizing roller 64 and the pressurizing pad 66. As a result, the pressurizing roller 64 and the fixing belt 62 form a contact region N, that is, a "nip part". In other words, the pressurizing roller 64 pressurizes the fixing belt 62 (i.e., a paper sheet K and a toner image) in the contact region N by sandwiching the fixing belt 62 together with the pressurizing pad 66.

Fitting members (not illustrated), such as caps, are fit to the ends of the pressurizing roller 64 in the axis direction in order to enhance the stiffness of the pressurizing roller 64 against an external force applied in the radial direction of the pressurizing roller 64. The fitting members are supported by bearing members (not illustrated) so as to be rotatable around the axis. Upon the fixing belt 62 being rotated, the pressurizing roller 64 is driven to rotate and, in the contact region N, transports a paper sheet K as a result of rotating together with the fixing belt 62.

Alternatively, the fixing belt 62 may be caused to rotate by the rotation of the pressurizing roller 64.

The pressurizing pad 66 is disposed on the inner peripheral surface of the fixing belt 62.

For example, the pressurizing pad 66 is a columnar member composed of a resin or a metal.

The pressurizing pad 66 sandwiches and pressurizes the fixing belt 62 (i.e., a paper sheet K and a toner image) in the contact region N together with the pressurizing roller 64, as a result of the pressurizing roller 64 being pressed against the pressurizing pad 66 with the fixing belt 62 interposed therebetween.

Alternatively, the pressurizing pad 66 may be pressed by an elastic member, such as a spring, against the pressurizing roller 64 with the fixing belt 62 interposed therebetween. In other words, the pressurizing pad 66 may be either a member that pressurizes the fixing belt 62 as a result of being pressed by the pressurizing roller 64 or a member that pressurizes the fixing belt 62 as a result of pressing the pressurizing roller 64.

Alternatively, a roller-like pressurizing member may be used instead of the pressurizing pad 66.

The halogen lamp 68 is disposed above the inner peripheral surface of the fixing belt 62. Specifically, for example, the halogen lamp 68 is arranged to face the contact region N with the pressurizing pad 66 interposed between the halogen lamp 68 and the contact region N. The halogen lamp 68 directly heats the contact region N.

The halogen lamp 68 is a cylindrical pipe-like halogen lamp that extends in the width direction of the fixing belt 62, that is, the direction of the rotation axis of the belt. Since the heat source of the halogen lamp 68 is a filament with a low heat capacity, the halogen lamp 68 quickly starts emitting heat after the power source has been turned on.

The heat sources known in the related art, such as a ceramic heater and a quartz lamp, may be used instead of the halogen lamp 68.

The reflective plate 70 is disposed above the inner peripheral surface of the fixing belt 62. Specifically, for example, the reflective plate 70 is arranged to face the contact region N with the halogen lamp 68 interposed between the reflective plate 70 and the contact region N.

For example, the reflective plate 70 is a plate-like metal member or a plate-like resin member including a metal layer formed on the reflecting surface by vapor deposition. For example, the reflective plate 70 is bent such that the inside of the bend faces the contact region N.

The reflective plate 70 reflects heat emitted from the halogen lamp 68 toward the contact region N.

In the fixing device 60 according to the first exemplary embodiment, a toner image formed on a paper sheet K is fixed to the paper sheet K as a result of being pressurized and heated in the contact region N formed between the fixing belt 62 and the pressurizing roller 64.

Fixing Device According to Second Exemplary Embodiment: DH2 Method

The fixing unit may further include a pressing member that is disposed downstream of the contact region and presses the rotatable body from the inside of the space surrounded by the fixing belt. In such a case, the rotatable body may include an elastic layer disposed on the surface of the rotatable body which is pressed together with the fixing belt.

Figure 3:
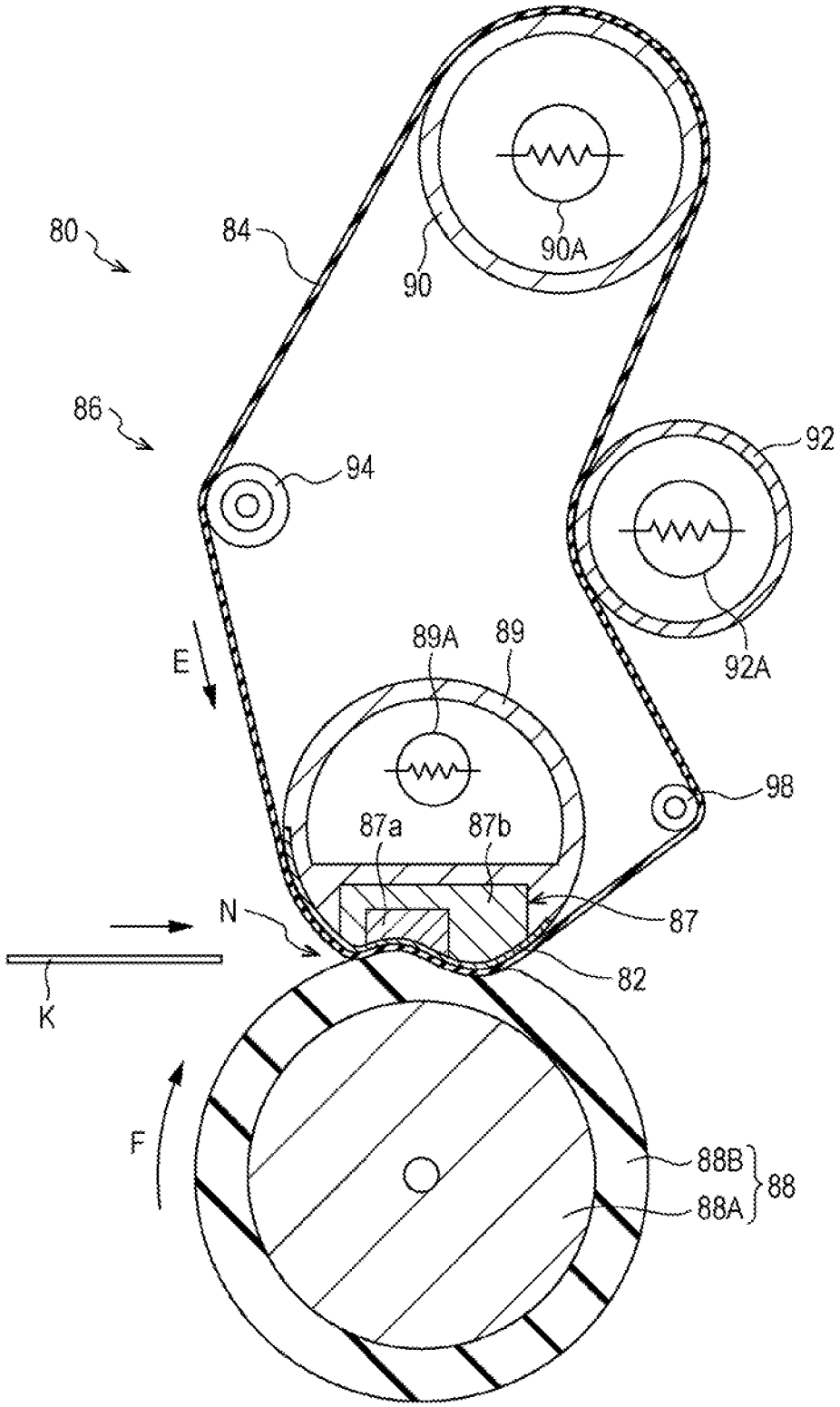
FIG. 3 is a schematic diagram illustrating an example of a fixing device according to a second exemplary embodiment.

FIG. 3 is a schematic diagram illustrating an example of a fixing device 80 according to a second exemplary embodiment.

The fixing device 80 includes a pressurizing roller 88 (an example of a first rotatable body) and a fixing belt module 86.

The fixing belt module 86 includes a heating belt 84 (an example of a second rotatable body), a pressing pad 87 (an example of the pressing member), a sliding member 82 (an example of the sliding member according to the exemplary embodiment), and a halogen heater 89A disposed in the vicinity of the pressing pad 87 (an example of the heat source).

The fixing belt module 86 further includes a support roller 90, a support roller 92, a position correction roller 94, and a support roller 98.

The pressurizing roller 88 is arranged to press the heating belt 84 (i.e., the fixing belt module 86). A pinching region N (nip part) is formed in the region in which the pressurizing roller 88 and the heating belt 84 (i.e., the fixing belt module 86) contact with each other.

The heating belt 84 is endless and rotatably supported by the pressing pad 87 and the support roller 90 disposed inside the space surrounded by the heating belt 84. The heating belt 84 is arranged to be pressed against the pressurizing roller 88 by the pressing pad 87 in the pinching region N (nip part).

The heating belt 84 is wound on the pressing pad 87, which presses the heating belt 84 against the pressurizing roller 88. The pressing pad 87 is arranged such that an elastic layer 88B becomes elastically deformed.

Specifically, the pressing pad 87 is arranged such that the elastic layer 88B becomes elastically deformed locally on the exit side of the fixing device 80. The pressing pad 87 includes a front pinching member 87*a* and a separate pinching member 87*b* and is supported by a holding member 89.

The front pinching member 87*a* has a concave shape conforming to the shape of the outer periphery of the pressurizing roller 88. The front pinching member 87*a* is disposed on the entry side of the pinching region N and maintains the length of the pinching region N (i.e., the distance in the sliding direction).

The separate pinching member 87*b* has a shape that protrudes toward the outer peripheral surface of the pressurizing roller 88. The separate pinching member 87*b* is disposed on the exit side of the pinching region N and causes the pressurizing roller 88 to become distorted locally in the exit region of the pinching region N. This makes it easy to separate the recording medium, to which a toner image has been fixed, from the pressurizing roller 88.

The pressing pad 87 is provided with a halogen heater 89A (an example of the heat source) disposed in the vicinity of the pressing pad 87 (e.g., inside of the holding member 89). The halogen heater 89A heats the heating belt 84 from the inner peripheral surface of the heating belt 84.

For example, a lubricant supplying device (not illustrated) that supplies a lubricant, such as an oil, onto the inner peripheral surface of the heating belt 84 may be disposed upstream of the front pinching member 87*a* included in the holding member 89.

The sliding member 82 has a sheet-like shape and is interposed between the heating belt 84 and the pressing pad 87 such that the sliding surface of the sliding member 82 (i.e., the surface of the sliding member 82 on which recesses are scattered) contacts with the inner peripheral surface of the heating belt 84.

The sliding member 82 is responsible for maintenance and supply of a lubricant, such as an oil, present between the sliding surface and the inner peripheral surface of the heating belt 84. The sliding member 82 has markedly high abrasion resistance and increases the service life of the fixing device 80.

The heating belt 84 is wound on the support roller 90, which supports the heating belt 84 at a position different from that of the pressing pad 87.

The support roller 90 includes a halogen heater 90A (an example of the heat source) disposed inside the support roller 90. The halogen heater 90A heats the heating belt 84 from the inner peripheral surface of the heating belt 84.

The support roller 90 is, for example, a roller that includes a hollow-cylindrical aluminum roller and a release layer disposed on the outer periphery surface of the aluminum roller. The release layer is, for example, a layer that has a thickness of 20 μm and is composed of a fluororesin.

The support roller 92 is arranged to be in contact with the outer peripheral surface of a segment of the heating belt 84 between the pressing pad 87 and the support roller 90 and defines the path over which the heating belt 84 revolves.

The support roller 92 includes a halogen heater 92A (an example of the heat source) disposed inside the support roller 92. The halogen heater 92A heats the heating belt 84 from the outer peripheral surface of the heating belt 84.

The support roller 92 is, for example, a roller that includes a hollow-cylindrical aluminum roller and a release layer disposed on the outer periphery surface of the aluminum roller. The release layer is, for example, a layer that has a thickness of 20 μm and is composed of a fluororesin.

The fixing device 80 may include at least one of the halogen heaters 89A, 90A, and 92A, which are examples of the heat source.

The position correction roller 94 is arranged to be in contact with the inner peripheral surface of a segment of the heating belt 84 between the support roller 90 and the pressing pad 87 and corrects the position of the segment of the heating belt 84 between the support roller 90 and the pressing pad 87.

The position correction roller 94 is provided with an edge position measuring mechanism (not illustrated) that is disposed in the vicinity of the position correction roller 94 and measures the position of the edge of the heating belt 84. The position correction roller 94 is provided with an axis displacement mechanism (not illustrated) that displaces the position at which the heating belt 84 contacts with the position correction roller 94 in the axial direction of the heating belt 84, in accordance with the results of the measurement performed by the edge position measuring mechanism. These mechanisms correct the position of the heating belt 84.

The position correction roller 94 is, for example, a solid-cylindrical aluminum roller.

The support roller 98 is arranged to be in contact with the inner peripheral surface of a segment of the heating belt 84 between the pressing pad 87 and the support roller 92 and applies a tension to the heating belt 84 from the inner peripheral surface of the heating belt 84 on the downstream side of the pinching region N.

The support roller 98 is, for example, a roller that includes a hollow-cylindrical aluminum roller and a release layer disposed on the outer periphery surface of the aluminum roller. The release layer is, for example, a layer that has a thickness of 20 μm and is composed of a fluororesin.

The pressurizing roller 88 is arranged to press the heating belt 84 at the position at which the heating belt 84 is wound on the pressing pad 87.

The pressurizing roller 88 is arranged rotatably and driven by the heating belt 84 to rotate in the direction of the arrow F upon the heating belt 84 rotating in the direction of the arrow E.

For example, the pressurizing roller 88 includes a solid-cylindrical aluminum roller 88A, the elastic layer 88B composed of a silicone rubber or the like which is disposed on the outer periphery surface of the aluminum roller 88A, and a release layer (not illustrated) disposed on the elastic layer 88B. The release layer is, for example, a layer that has a thickness of 100 μm and is composed of a fluororesin.

For example, the support rollers 90 and 92 are driven by a driving motor (not illustrated) to rotate. The rotation of the support rollers 90 and 92 causes the heating belt 84 to rotate in the direction of the arrow E. The rotation of the heating belt 84 causes the pressurizing roller 88 to rotate in the direction of the arrow F.

A paper sheet K (i.e., a recording medium) that includes an unfixed toner image is transported to the pinching region N of the fixing device 80. When the paper sheet K passes through the pinching region N, the toner image present on the paper sheet K is fixed to the paper sheet K by pressure and heat applied to the pinching region N.

Fixing Device According to Third Exemplary Embodiment: Electromagnetic Induction Heating Method The fixing unit may be an electromagnetic induction fixing unit. In the case where the fixing unit is an electromagnetic induction fixing unit, the fixing unit may include an electromagnetic induction heating device and a metal layer disposed inside the fixing belt, the metal layer serving as a heat source.

Figure 4:
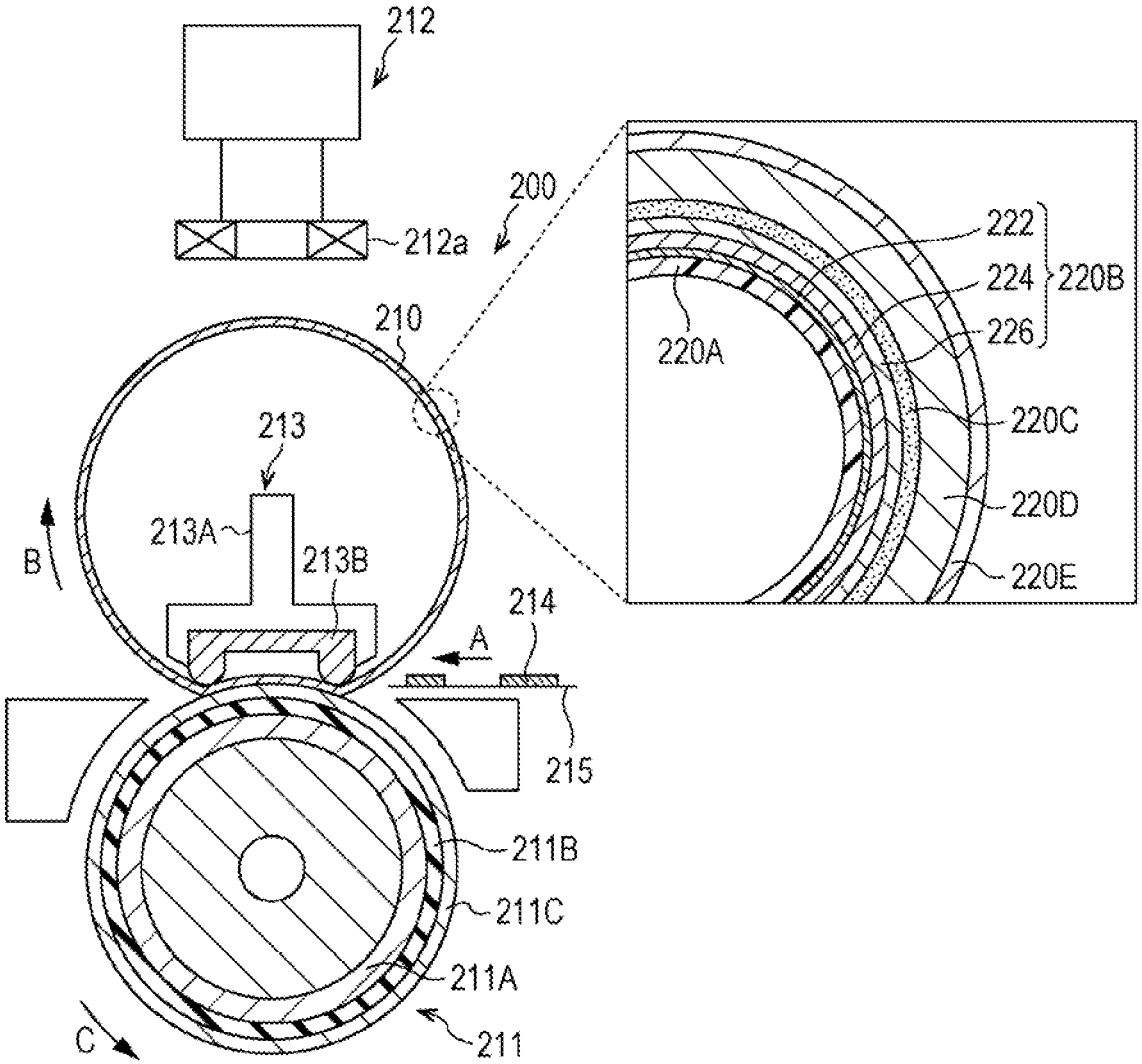
FIG. 4 is a schematic diagram illustrating an example of a fixing device according to a third exemplary embodiment.

FIG. 4 is a schematic diagram illustrating an example of a fixing device according to a third exemplary embodiment.

A fixing device 200 according to the third exemplary embodiment is an electromagnetic induction fixing device that includes a fusing member having a hybrid substrate.

As illustrated in FIG. 4, a pressurizing roller 211 (an example of a second rotatable body) is arranged to pressurize a portion of a heating belt 210 (an example of a first rotatable body); a contact region (nip) is formed between the heating belt 210 and the pressurizing roller 211 in order to fix a toner image in an efficient manner; and the portion of the heating belt 210 is bent along the periphery of the pressurizing roller 211. In order to increase ease of separation of a recording medium, bends are formed at the ends of the contact region (nip) in which the belt is bent.

The pressurizing roller 211 includes a substrate 211A; an elastic layer 211B disposed on the substrate 211A and composed of a silicone rubber or the like; and a release layer 211C disposed on the elastic layer 211B and composed of a fluorine-containing compound.

The heating belt 210 is provided with an opposite member 213, which is disposed inside the space surrounded by the heating belt 210 so as to face the pressurizing roller 211. The opposite member 213 is composed of a metal, a heat-resistant resin, a heat-resistant rubber, or the like and includes a pad 213B arranged to be in contact with the inner peripheral surface of the heating belt 210 in order to locally pressurize the heating belt 210 and a support 213A that supports the pad 213B.

The heating belt 210 is a multilayer endless belt that includes a substrate 220A, a metal layer 220B disposed on the outer peripheral surface of the substrate 220A, an adhesive layer 220C disposed on the metal layer 220B, an elastic layer 220D disposed on the adhesive layer 220C, and a release layer 220E disposed on the elastic layer 220D. The metal layer 220B includes a base metal layer 222, an electromagnetic induction metal layer 224 that produces heat by electromagnetic induction, and a metal protection layer 226, which are stacked on top of one another in this order.

The metal layer 220B may be any metal layer that includes a nickel coating. Although the metal layer 220B according to the exemplary embodiment includes the base metal layer 222, the electromagnetic induction metal layer 224, and the metal protection layer 226 stacked on top of one another in this order, the number of the metal layers is not limited.

The substrate 220A may be a layer the physical properties of which do not vary significantly and which maintains a high strength even when the metal layer 220B is generating heat. Accordingly, the substrate 220A may be composed primarily of a heat-resistant resin.

The base metal layer 222 is a layer optionally formed as needed in order to form the electromagnetic induction metal layer 224 on the outer peripheral surface of the substrate 220A by electrolytic plating or the like.

The electromagnetic induction metal layer 224 is a heat generating layer capable of generating heat using an eddy current generated inside the electromagnetic induction metal layer 224 upon the application of a magnetic field. The electromagnetic induction metal layer 224 is composed of a metal that causes electromagnetic induction.

The metal protection layer 226 may be disposed on the outer periphery surface of the electromagnetic induction metal layer 224 so as to contact with the electromagnetic induction metal layer 224.

The adhesive layer 220C is a layer interposed between the metal layer 220B and the elastic layer 220D.

The elastic layer 220D is a layer formed in order to impart elasticity to the fusing member against a pressure applied to the fusing member from the outer periphery of the fusing member. For example, the elastic layer 220D is a layer that enables the surface of the fusing member to follow the irregularities of a toner image present on a recording medium and contact with the toner image.

The release layer 220E is a layer that inhibits a molten toner image from adhering to a surface of the fusing member which contacts with a recording medium (i.e., the outer peripheral surface of the fusing member) in the fixing step. The release layer 220E is optional.

On a side of heating belt 210 which is opposite to the side on which the pressurizing roller 211 is disposed, an electromagnetic induction heating device 212 that includes an electromagnetic induction coil (an example of a heat generating layer) 212*a* is disposed. The electromagnetic induction heating device 212 changes the magnetic field with an excitation circuit by applying an alternating current to an electromagnetic induction coil and generates an eddy current inside the metal layer (i.e., the electromagnetic induction metal layer 224) included in the heating belt 210. The eddy current is converted to heat (Joule heat) by the electrical resistance of the metal layer 220B. As a result, the surface of the heating belt 210 generates heat.

The position of the electromagnetic induction heating device 212 is not limited to that illustrated in FIG. 4. Alternatively, for example, the electromagnetic induction heating device 212 may be disposed upstream of the contact region of the heating belt 210 in the rotating direction B. In another case, the electromagnetic induction heating device 212 may be disposed inside the space surrounded by the heating belt 210.

In the fixing device 200 according to the third exemplary embodiment, upon a drive unit transmitting a driving force to a gear fixed to the edge of the heating belt 210, the heating belt 210 rotates in the direction of the arrow B. The rotation of the heating belt 210 causes the pressurizing roller 211 to rotate in the opposite direction, that is, in the direction of the arrow C.

A recording medium 215 on which an unfixed toner image 214 is formed is passed through a contact region (nip) formed between the heating belt 210 and the pressurizing roller 211 of the fixing device 200 in the direction of the arrow A. The unfixed toner image 214 is pressurized while being in a molten state. Thus, the unfixed toner image 214 is fixed to the recording medium 215.

Fixing Device According to Fourth Exemplary Embodiment: Linear Heating Element Method The fixing unit may be a fixing unit that includes a linear heating element as a heat source. The fixing unit that includes a linear heating element as a heat source may include a power supply unit that applies a pulsed current to the linear heating element. The fixing unit that includes a linear heating element as a heat source may include a sliding member arranged slidable together with the linear heating element, a power supply unit that applies a pulsed current to the linear heating element, and a cooling unit that cools a fixed image formed by fixing the toner image transferred on the surface of the recording medium, wherein the linear heating element heats the contact region with the sliding member interposed between the linear heating element and the contact region.

Figure 5:
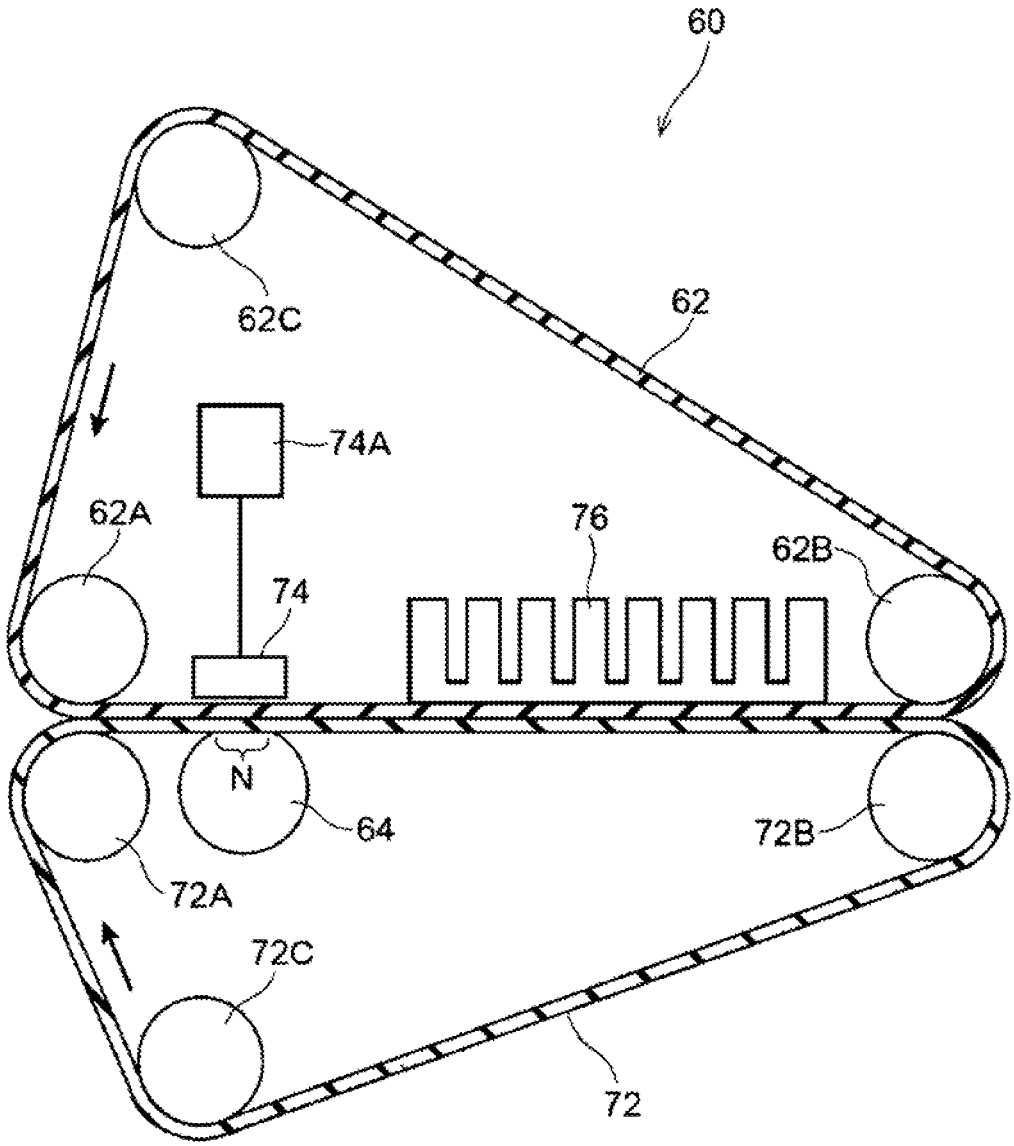
FIG. 5 is a schematic diagram illustrating an example of a fixing device according to a fourth exemplary embodiment.

FIG. 5 is a schematic diagram illustrating an example of a fixing device according to a fourth exemplary embodiment. In FIG. 5, members having substantially the same function as the members of the fixing device 60 according to the first exemplary embodiment are denoted with the same reference numerals, and the description thereof is omitted.

A fixing device 60 according to the fourth exemplary embodiment includes a fixing belt 62, a pressurizing roller 64 (an example of the rotatable body), a paper sheet transporting belt 72, a linear heating element 74 (an example of the heat source and the pressurizing member), a pulse power supply unit 74A, and a heat sink 76 (an example of the cooling unit), as illustrated in FIG. 5.

The outer peripheral surfaces of the fixing belt 62 and the pressurizing roller 64 are in contact with each other with the paper sheet transporting belt 72 interposed therebetween to form a contact region N. The fixing belt 62 and the pressurizing roller 64 are rotated together with each other to transport a paper sheet K in the contact region N.

Note that, the contact region N in which the outer peripheral surfaces of the fixing belt 62 and the pressurizing roller 64 are in contact with each other includes a contact region N formed as a result of the fixing belt 62 and the pressurizing roller 64 contacting with each other with another member, such as the paper sheet transporting belt 72, interposed therebetween.

The fixing belt 62 is supported by rotatable support rollers 62A, 62B, and 62C while a tension is applied to the fixing belt 62 by the rotatable support rollers 62A, 62B, and 62C. The first of the three rotatable support rollers 62A, 62B, and 62C next to the position at which the linear heating element 74 is disposed in the direction of rotation of the fixing belt 62, that is, the rotatable support roller 62B, serves as a driving roller that drives the fixing belt 62 to rotate.

The pressurizing roller 64 is disposed on the inner peripheral surface of the paper sheet transporting belt 72. In a portion of the outer peripheral surface of the pressurizing roller 64, a bearing member (not illustrated) is pressed by an elastic member, such as a spring, against the linear heating element 74 with the fixing belt 62 and the paper sheet transporting belt 72 that are interposed between the pressurizing roller 64 and the linear heating element 74. Accordingly, the pressurizing roller 64 and the fixing belt 62 form a contact region N, that is, "nip part", with the paper sheet transporting belt 72 interposed therebetween. In other words, in the contact region N, the pressurizing roller 64 sandwiches and pressurizes the fixing belt 62 and the paper sheet transporting belt 72 (i.e., a paper sheet K and a toner image) together with the pressurizing pad 66.

The paper sheet transporting belt 72 is supported by rotatable support rollers 72A, 72B, and 72C while a tension is applied to the paper sheet transporting belt 72 by the rotatable support rollers 72A, 72B, and 72C. The paper sheet transporting belt 72 is caused to rotate by the rotation of the fixing belt 62.

The rotatable support rollers 62A and 62B that support the fixing belt 62 are arranged to face the rotatable support rollers 72A and 72B that support the paper sheet transporting belt 72, respectively, with the fixing belt 62 and the paper sheet transporting belt 72 interposed therebetween. That is, the outer peripheral surfaces of the fixing belt 62 and the paper sheet transporting belt 72 face each other between the rotatable support rollers 62A and 72A and the rotatable support rollers 62B and 72B.

The linear heating element 74 is disposed on the inner peripheral surface of the fixing belt 62. Specifically, the linear heating element 74 is arranged to face the contact region N. The linear heating element 74 directly heats the contact region N.

The linear heating element 74 also sandwiches and pressurizes the fixing belt 62 (i.e., a paper sheet K and a toner image) together with the pressurizing roller 64 in the contact region N as a result of the pressurizing roller 64 being pressed against the linear heating element 74 with the fixing belt 62 and the paper sheet transporting belt 72 interposed between the pressurizing roller 64 and the linear heating element 74.

The linear heating element 74 is an extra-long member that extends in the width direction of the fixing belt 62 (i.e., the direction of rotation axis of the belt). The linear heating element 74 is, for example, a heat source that includes a substrate and a linear heating portion disposed on the substrate, the linear heating portion being constituted by plural heating resistors arranged in a line, which serve as heat sources. That is, the linear heating element 74 is a heating element distinctive from heating elements composed of a nichrome wire. Examples of the linear heating element 74 include a thermal head.

The pulse power supply unit 74A includes a power source and is electrically connected to the linear heating element 74 in order to apply a pulsed current to the linear heating element 74. Specifically, the pulse power supply unit 74A applies a pulsed current to the heating resistors.

Examples of the shape of the pulsed current applied by the pulse power supply unit 74A include a rectangular wave, a triangular wave, and a sine wave. It is not necessary to turn off the pulse power supply unit 74A during intervals between pulses.

The pulse power supply unit 74A is connected to the controller 40. The controller 40 controls the pulse power supply unit 74A and causes the pulse power supply unit 74A to apply a pulsed current to the linear heating element 74.

The heat sink 76 is arranged to be in contact with the inner peripheral surface of the fixing belt 62.

Specifically, for example, the heat sink 76 is disposed downstream of the contact region N in the direction of rotation of the fixing belt 62.

The heat sink 76 absorbs and dissipates the heat of the fixing belt 62 to cool the fixing belt 62, at the position downstream of the contact region N, which is heated, in the direction of rotation of the fixing belt 62. This cools the fixed image formed by fixing the toner image in the contact region N.

In the above-described fixing device 60 according to the fourth exemplary embodiment, a toner image is fixed to a paper sheet K as a result of the paper sheet K, on which the toner image is formed, being pressurized and heated in the contact region N, in which the fixing belt 62 and the pressurizing roller 64 are in contact with each other with the paper sheet transporting belt 72 interposed therebetween. The fixed image present on the paper sheet K is cooled with the heat sink 76 and then separated from the fixing belt 62.

The linear heating element 74 may have a number of heating regions as with a thermal head or the like. This makes it easy to control the amount of heat generated by the linear heating element 74.

After the image fixed to the paper sheet K in the contact region N has been cooled with the heat sink 76 (i.e., after the molten toner particles constituting the image have been solidified), the fixed image is separated from the fixing belt 62.

Figure 6:
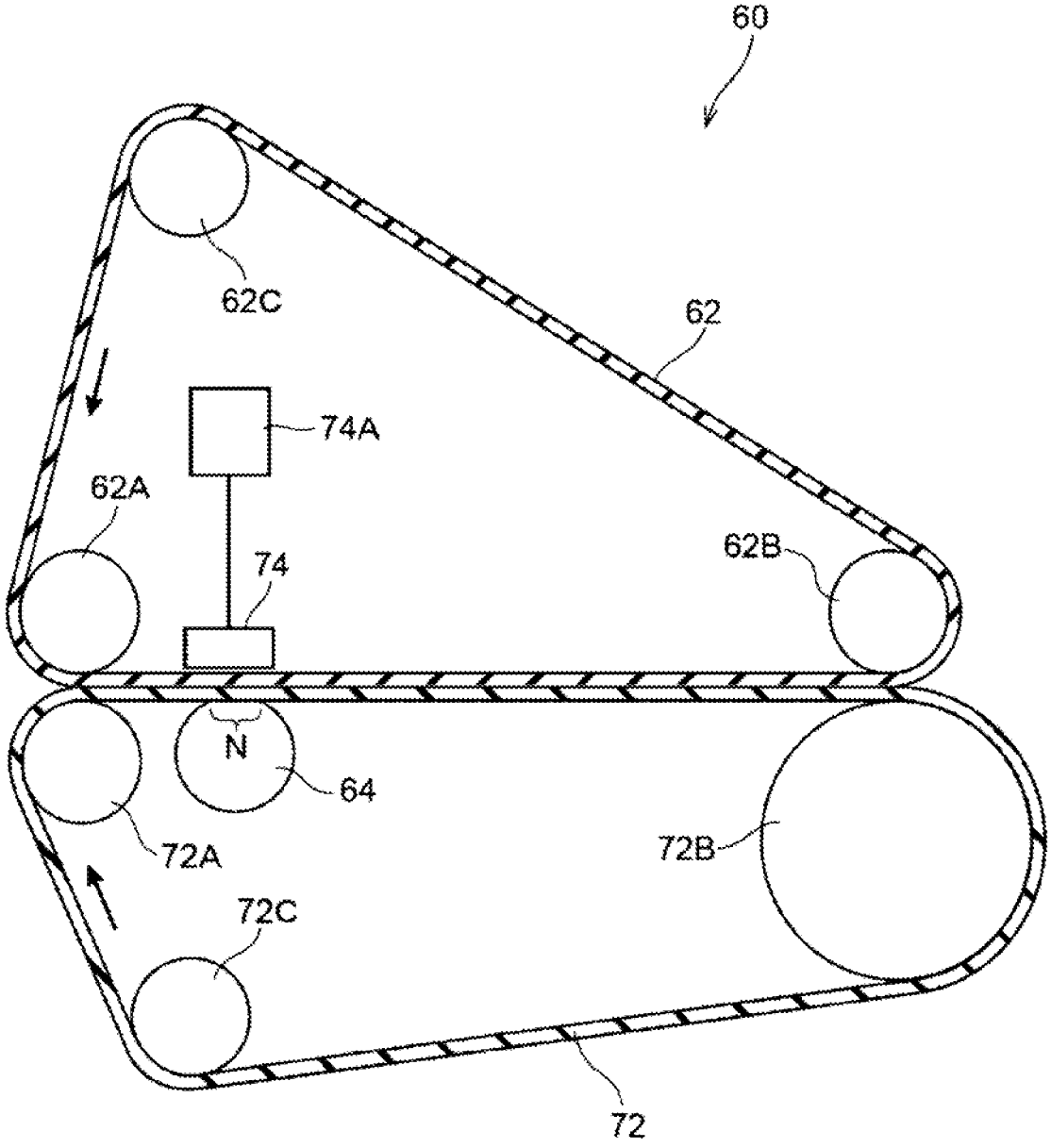
FIG. 6 is a schematic diagram illustrating another example of the fixing device according to the fourth exemplary embodiment.

Alternatively, the heat sink 76 may be omitted. In such a case, the diameter of the rotatable support roller 72B, which is disposed at a position at which the fixed image is separated from the fixing belt 62 and which supports the paper sheet transporting belt 72, is increased, and the rotatable support roller 72B having a large diameter is used as a cooling unit (see FIG. 6). Increasing the diameter of the rotatable support roller 72B (i.e., specifically, for example, setting the diameter of the rotatable support roller 72B to be larger than the diameter of the rotatable support roller 62B that supports the fixing belt 62) enables the fixed image to be cooled by the rotatable support roller 72B with the paper sheet transporting belt 72 interposed between the fixed image and the rotatable support roller 72B.

Electrostatic Image Developer

An electrostatic image developer according to the exemplary embodiment includes at least a toner.

The electrostatic image developer according to the exemplary embodiment may be a single component developer including only the toner or may be a two-component developer that includes the toner and a carrier.

Toner

The toner according to the exemplary embodiment includes toner particles and silica particles having a number average particle size of 110 nm or more and 130 nm or less, a large-diameter-side number particle size distribution index (upper GSDp) of less than 1.080, and an average circularity of 0.94 or more and 0.98 or less, wherein 80 number % or more of the silica particles have a circularity of 0.92 or more. The toner according to the exemplary embodiment further includes, as needed, inorganic oxide particles, lubricant particles, and external additive particles other than the inorganic oxide particles or the lubricant particles.

Toner Particles

The toner particles include, for example, a binder resin and may optionally include a colorant, a release agent, and other additives.

Binder Resin

Examples of the binder resin include vinyl resins that are homopolymers of the following monomers or copolymers of two or more monomers selected from the following monomers: styrenes, such as styrene, para-chlorostyrene, and α-methylstyrene; (meth)acrylates, such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; ethylenically unsaturated nitriles, such as acrylonitrile and methacrylonitrile; vinyl ethers, such as vinyl methyl ether and vinyl isobutyl ether; vinyl ketones, such as vinyl methyl ketone, vinyl ethyl ketone, and vinyl isopropenyl ketone; and olefins, such as ethylene, propylene, and butadiene.

Examples of the binder resin further include non-vinyl resins, such as epoxy resins, polyester resins, polyurethane resins, polyamide resins, cellulose resins, polyether resins, and modified rosins; a mixture of the non-vinyl resin and the vinyl resin; and a graft polymer produced by polymerization of the vinyl monomer in the presence of the non-vinyl resin.

The above binder resins may be used alone or in combination of two or more.

(1) Styrene Acrylic Resin

The binder resin may be a styrene acrylic resin.

A styrene acrylic resin is a copolymer produced by copolymerization of at least a monomer including a styrene skeleton (hereinafter, referred to as "styrene-based monomer") with a monomer that includes a (meth)acryloyl group and preferably includes a (meth)acryloyloxy group (hereinafter, referred to as "(meth)acryl-based monomer"). The styrene acrylic resin includes, for example, a copolymer of a monomer selected from the styrenes with a monomer selected from the above-described (meth)acrylate esters. The acrylic resin portion of the styrene acrylic resin is a structural unit produced by polymerization of an acryl-based monomer, a methacryl-based monomer, or both acryl-based monomer and methacryl-based monomer. The term "(meth) acryl" used herein refers to both "acryl" and "methacryl".

Specific examples of the styrene-based monomer include styrene; alkyl-substituted styrenes, such as α-methylstyrene, 2-methylstyrene, 3-methylstyrene, 4-methylstyrene, 2-ethylstyrene, 3-ethylstyrene, and 4-ethylstyrene; halogen-substituted styrenes, such as 2-chlorostyrene, 3-chlorostyrene, and 4-chlorostyrene; and vinylnaphthalene. The above styrene-based monomers may be used alone or in combination of two or more.

Among these styrene-based monomers, styrene is preferable in terms of ease of reaction, ease of controlling reaction, and ease of availability.

Specific examples of the (meth)acryl-based monomer include (meth)acrylic acid and (meth)acrylate esters. Examples of the (meth)acrylate esters include alkyl (meth) acrylate esters, such as methyl (meth)acrylate, ethyl (meth) acrylate, n-propyl (meth)acrylate, n-butyl (meth)acrylate, n-pentyl (meth)acrylate, n-hexyl acrylate, n-heptyl (meth) acrylate, n-octyl (meth)acrylate, n-decyl (meth)acrylate, n-dodecyl (meth)acrylate, n-lauryl (meth) acrylate, n-tetradecyl (meth) acrylate, n-hexadecyl (meth) acrylate, n-octadecyl (meth) acrylate, isopropyl (meth)acrylate, isobutyl (meth)acrylate, t-butyl (meth)acrylate, isopentyl (meth) acrylate, amyl (meth)acrylate, neopentyl (meth)acrylate, isohexyl (meth)acrylate, isoheptyl (meth)acrylate, isooctyl (meth) acrylate, 2-ethylhexyl (meth) acrylate, cyclohexyl (meth)acrylate, and t-butylcyclohexyl (meth)acrylate); aryl (meth)acrylate esters, such as phenyl (meth)acrylate, biphenyl (meth)acrylate, diphenylethyl (meth)acrylate, t-butylphenyl (meth)acrylate, and terphenyl (meth)acrylate; dimethylaminoethyl (meth) acrylate; diethylaminoethyl (meth) acrylate; methoxyethyl (meth) acrylate; 2-hydroxyethyl (meth)acrylate; β-carboxyethyl (meth)acrylate; and (meth) acrylamide. The above (meth)acryl-based monomers may be used alone or in combination of two or more.

Among the above (meth)acrylate esters, a (meth)acrylate ester including an alkyl group having 2 to 14 carbon atoms, preferably having 2 to 10 carbon atoms, and more preferably having 3 to 8 carbon atoms is preferable in order to enhance the fixability of the toner. In particular, n-butyl (meth) acrylate is preferable, and n-butyl acrylate is particularly preferable.

The copolymerization ratio between the styrene-based monomer and the (meth)acryl-based monomer (by mass, [Styrene-based monomer]/[(Meth)acryl-based monomer]) may be, but not limited to, 90/10 to 60/40.

The styrene acrylic resin may include a crosslinked structure. The styrene acrylic resin including a crosslinked structure is, for example, a copolymer of at least the styrene-based monomer, the (meth)acryl-based monomer, and a crosslinkable monomer.

Examples of the crosslinkable monomer include crosslinking agents having two or more functional groups.

Examples of the difunctional crosslinking agent include divinylbenzene; divinylnaphthalene; di(meth)acrylates, such as diethylene glycol di(meth)acrylate, methylene bis (meth)acrylamide, decanediol diacrylate, and glycidyl (meth)acrylate; polyester di(meth)acrylate; and 2-([1'-methylpropylideneamino]carboxyamino)ethyl methacrylate.

Examples of the crosslinking agents having three or more functional groups include tri(meth)acrylates, such as pentaerythritol tri(meth)acrylate, trimethylolethane tri(meth) acrylate, and trimethylolpropane tri(meth)acrylate; tetra(meth)acrylates, such as pentaerythritol tetra(meth)acrylate and oligoester (meth)acrylate; 2,2-bis(4-methacryloxy polyethoxyphenyl)propane; diallyl phthalate; triallyl cyanurate; triallyl isocyanurate; triallyl trimellitate; and diallyl chlorendate.

Among the above crosslinkable monomers, in order to enhance the fixability of the toner, a (meth)acrylate having two or more functional groups is preferable, a difunctional (meth)acrylate is more preferable, a difunctional (meth) acrylate including an alkylene group having 6 to 20 carbon atoms is further preferable, and a difunctional (meth)acrylate including a linear alkylene group having 6 to 20 carbon atoms is particularly preferable.

The copolymerization ratio of the crosslinkable monomer to all the monomers (by mass, [Crosslinkable monomer]/[All monomers]) may be, but not limited to, 2/1,000 to 20/1,000.

The glass transition temperature (Tg) of the styrene acrylic resin is preferably 40° C. or more and 75° C. or less and is more preferably 50° C. or more and 65° C. or less in order to enhance the fixability of the toner.

Glass transition temperature is determined from a differential scanning calorimetry (DSC) curve obtained by DSC. More specifically, the glass transition temperature is determined from the "extrapolated glass-transition-starting temperature" according to a method for determining glass transition temperature which is described in JIS K 7121-1987 "Testing Methods for Transition Temperatures of Plastics".

The weight average molecular weight of the styrene acrylic resin is preferably 5,000 or more and 200,000 or less, is more preferably 10,000 or more and 100,000 or less, and is particularly preferably 20,000 or more and 80,000 or less in order to enhance the preservation stability of the toner.

The method for preparing the styrene acrylic resin is not limited; various polymerization methods, such as solution polymerization, precipitation polymerization, suspension polymerization, bulk polymerization, and emulsion polymerization, may be used. The polymerization reaction may be conducted by any suitable process known in the related art, such as a batch process, a semi-continuous process, or a continuous process.

(2) Polyester Resin

The binder resin may be a polyester resin.

Examples of the polyester resin include amorphous polyester resins known in the related art. A crystalline polyester resin may be used as a polyester resin in combination with an amorphous polyester resin. In such a case, the content of the crystalline polyester resin in the binder resin may be 2% by mass or more and 40% by mass or less and is preferably 2% by mass or more and 20% by mass or less.

The term "crystalline" resin used herein refers to a resin that, in thermal analysis using differential scanning calorimetry (DSC), exhibits a distinct endothermic peak instead of step-like endothermic change and specifically refers to a resin that exhibits an endothermic peak with a half-width of 10° C. or less at a heating rate of 10° C./min.

On the other hand, the term "amorphous" resin used herein refers to a resin that exhibits an endothermic peak with a half-width of more than 10° C., that exhibits step-like endothermic change, or that does not exhibit a distinct endothermic peak.

Amorphous Polyester Resin

Examples of the amorphous polyester resin include condensation polymers of a polyvalent carboxylic acid and a polyhydric alcohol. The amorphous polyester resin may be a commercially available one or a synthesized one.

Examples of the polyvalent carboxylic acid include aliphatic dicarboxylic acids, such as oxalic acid, malonic acid, maleic acid, fumaric acid, citraconic acid, itaconic acid, glutaconic acid, succinic acid, alkenyl succinic acid, adipic acid, and sebacic acid; alicyclic dicarboxylic acids, such as cyclohexanedicarboxylic acid; aromatic dicarboxylic acids, such as terephthalic acid, isophthalic acid, phthalic acid, and naphthalenedicarboxylic acid; anhydrides of these dicarboxylic acids; and lower (e.g., 1 to 5 carbon atoms) alkyl esters of these dicarboxylic acids. Among these dicarboxylic acids, for example, aromatic dicarboxylic acids may be used as a polyvalent carboxylic acid.

Trivalent or higher carboxylic acids having a crosslinked structure or a branched structure may be used as a polyvalent carboxylic acid in combination with the dicarboxylic acids. Examples of the trivalent or higher carboxylic acids include trimellitic acid, pyromellitic acid, anhydrides of these carboxylic acids, and lower (e.g., 1 to 5 carbon atoms) alkyl esters of these carboxylic acids.

The above polyvalent carboxylic acids may be used alone or in combination of two or more.

Examples of the polyhydric alcohol include aliphatic diols, such as ethylene glycol, diethylene glycol, triethylene glycol, propylene glycol, butanediol, hexanediol, and neopentyl glycol; alicyclic diols, such as cyclohexanediol, cyclohexanedimethanol, and hydrogenated bisphenol A; and aromatic diols, such as bisphenol A-ethylene oxide adducts and bisphenol A-propylene oxide adducts. Among these diols, for example, aromatic diols and alicyclic diols may be used as a polyhydric alcohol. In particular, aromatic diols may be used as a polyhydric alcohol.

Trihydric or higher alcohols having a crosslinked structure or a branched structure may be used as a polyhydric alcohol in combination with the diols. Examples of the trihydric or higher alcohols include glycerin, trimethylolpropane, and pentaerythritol.

The above polyhydric alcohols may be used alone or in combination of two or more.

The glass transition temperature Tg of the amorphous polyester resin is preferably 50° C. or more and 80° C. or less and is more preferably 50° C. or more and 65° C. or less.

The glass transition temperature is determined from a DSC curve obtained by differential scanning calorimetry (DSC). More specifically, the glass transition temperature is determined from the "extrapolated glass-transition-starting temperature" according to a method for determining glass transition temperature which is described in JIS K 7121-1987 "Testing Methods for Transition Temperatures of Plastics".

The weight average molecular weight Mw of the amorphous polyester resin is preferably 5,000 or more and 1,000,000 or less and is more preferably 7,000 or more and 500,000 or less.

The number average molecular weight Mn of the amorphous polyester resin is preferably 2,000 or more and 100,000 or less.

The molecular weight distribution index Mw/Mn of the amorphous polyester resin is preferably 1.5 or more and 100 or less and is more preferably 2 or more and 60 or less.

The weight average molecular weight and number average molecular weight of the amorphous polyester resin are determined by gel permeation chromatography (GPC). Specifically, the molecular weights of the amorphous polyester resin are determined by GPC using a "HLC-8120GPC" produced by Tosoh Corporation as measuring equipment, a column "TSKgel SuperHM-M (15 cm)" produced by Tosoh Corporation, and a tetrahydrofuran (THF) solvent. The weight average molecular weight and number average molecular weight of the amorphous polyester resin are determined on the basis of the results of the measurement using a molecular weight calibration curve based on monodisperse polystyrene standard samples.

The amorphous polyester resin may be produced by any suitable production method known in the related art. Specifically, the amorphous polyester resin may be produced by, for example, a method in which polymerization is performed at 180° C. or more and 230° C. or less, the pressure inside the reaction system is reduced as needed, and water and alcohols that are generated by condensation are removed.

In the case where the raw materials, that is, the monomers, are not dissolved in or miscible with each other at the reaction temperature, a solvent having a high boiling point may be used as a dissolution adjuvant in order to dissolve the raw materials. In such a case, the condensation polymerization reaction is performed while the dissolution adjuvant is distilled away. In the case where the monomers have low miscibility with each other, a condensation reaction of the monomers with an acid or alcohol that is to undergo a polycondensation reaction with the monomers may be performed in advance and subsequently polycondensation of the resulting polymers with the other components may be performed.

Crystalline Polyester Resin

Examples of the crystalline polyester resin include condensation polymers of a polyvalent carboxylic acid and a polyhydric alcohol. The crystalline polyester resin may be commercially available one or a synthesized one.

In order to increase ease of forming a crystal structure, a condensation polymer prepared from linear aliphatic polymerizable monomers may be used as a crystalline polyester resin instead of a condensation polymer prepared from aromatic polymerizable monomers.

Examples of the polyvalent carboxylic acid include aliphatic dicarboxylic acids, such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid; aromatic dicarboxylic acids, such as dibasic acids (e.g., phthalic acid, isophthalic acid, terephthalic acid, and naphthalene-2,6-dicarboxylic acid); anhydrides of these dicarboxylic acids; and lower (e.g., 1 to 5 carbon atoms) alkyl esters of these dicarboxylic acids.

Trivalent or higher carboxylic acids having a crosslinked structure or a branched structure may be used as a polyvalent carboxylic acid in combination with the dicarboxylic acids. Examples of the trivalent carboxylic acids include aromatic carboxylic acids, such as 1,2,3-benzenetricarboxylic acid, 1,2,4-benzenetricarboxylic acid, and 1,2,4-naphthalenetricarboxylic acid; anhydrides of these tricarboxylic acids; and lower (e.g., 1 to 5 carbon atoms) alkyl esters of these tricarboxylic acids.

Dicarboxylic acids including a sulfonic group and dicarboxylic acids including an ethylenic double bond may be used as a polyvalent carboxylic acid in combination with the above dicarboxylic acids.

The above polyvalent carboxylic acids may be used alone or in combination of two or more.

Examples of the polyhydric alcohol include aliphatic diols, such as linear aliphatic diols including a backbone having 7 to 20 carbon atoms. Examples of the aliphatic diols include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,14-eicosanedecanediol. Among these aliphatic diols, 1,8-octanediol, 1,9-nonanediol, and 1,10-decanediol may be used.

Trihydric or higher alcohols having a crosslinked structure or a branched structure may be used as a polyhydric alcohol in combination with the above diols. Examples of the trihydric or higher alcohols include glycerin, trimethylolethane, trimethylolpropane, and pentaerythritol.

The above polyhydric alcohols may be used alone or in combination of two or more.

The content of the aliphatic diols in the polyhydric alcohol may be 80 mol % or more and is preferably 90 mol % or more.

The melting temperature of the crystalline polyester resin is preferably 50° C. or more and 100° C. or less, is more preferably 55° C. or more and 90° C. or less, and is further preferably 60° C. or more and 85° C. or less.

The melting temperature of the crystalline polyester resin is determined from the "melting peak temperature" according to a method for determining melting temperature which is described in JIS K 7121-1987 "Testing Methods for Transition Temperatures of Plastics" using a DSC curve obtained by differential scanning calorimetry (DSC).

The crystalline polyester resin may have a weight average molecular weight Mw of 6,000 or more and 35,000 or less.

The crystalline polyester resin may be produced by any suitable method known in the related art similarly to, for example, the amorphous polyester resin.

The content of the binder resin in the toner particles is preferably, for example, 40% by mass or more and 95% by mass or less, is more preferably 50% by mass or more and 90% by mass or less, and is further preferably 60% by mass or more and 85% by mass or less.

Colorant

Examples of the colorant include various pigments, such as Carbon Black, Chrome Yellow, Hansa Yellow, Benzidine Yellow, Threne Yellow, Quinoline Yellow, Pigment Yellow, Permanent Orange GTR, Pyrazolone Orange, Vulcan Orange, Watching Red, Permanent Red, Brilliant Carmine 3B, Brilliant Carmine 6B, DuPont Oil Red, Pyrazolone Red, Lithol Red, Rhodamine B Lake, Lake Red C, Pigment Red, Rose Bengal, Aniline Blue, Ultramarine Blue, Calco Oil Blue, Methylene Blue Chloride, Phthalocyanine Blue, Pigment Blue, Phthalocyanine Green, and Malachite Green Oxalate; and various dyes, such as acridine dyes, xanthene dyes, azo dyes, benzoquinone dyes, azine dyes, anthraquinone dyes, thioindigo dyes, dioxazine dyes, thiazine dyes, azomethine dyes, indigo dyes, phthalocyanine dyes, aniline black dyes, polymethine dyes, triphenylmethane dyes, diphenylmethane dyes, and thiazole dyes.

The above colorants may be used alone or in combination of two or more.

The colorant may optionally be subjected to a surface treatment and may be used in combination with a dispersant. Plural types of colorants may be used in combination.

The content of the colorant in the toner particles is preferably, for example, 1% by mass or more and 30% by mass or less and is more preferably 3% by mass or more and 15% by mass or less.

Release Agent

Examples of the release agent include, but are not limited to, hydrocarbon waxes; natural waxes, such as a carnauba wax, a rice bran wax, and a candelilla wax; synthetic or mineral-petroleum-derived waxes, such as a montan wax; and ester waxes, such as a fatty-acid ester wax and a montanate wax.

The melting temperature of the release agent is preferably 50° C. or more and 110° C. or less and is more preferably 60° C. or more and 100° C. or less.

The melting temperature of the release agent is determined from the "melting peak temperature" according to a method for determining melting temperature which is described in JIS K 7121-1987 "Testing Methods for Transition Temperatures of Plastics" using a DSC curve obtained by differential scanning calorimetry (DSC).

The content of the release agent in the toner particles is preferably, for example, 1% by mass or more and 20% by mass or less and is more preferably 5% by mass or more and 15% by mass or less.

Other Additives

Examples of the other additives include additives known in the related art, such as a magnetic substance, a charge-controlling agent, and an inorganic powder. These additives may be added to the toner particles as internal additives.

Properties of Toner Particles

The toner particles may have a single-layer structure or a "core-shell" structure constituted by a core (i.e., core particle) and a coating layer (i.e., shell layer) covering the core.

The core-shell structure of the toner particles may be constituted by, for example, a core including a binder resin and, as needed, other additives such as a colorant and a release agent and by a coating layer including the binder resin.

The volume average diameter D50*v* of the toner particles is preferably 2 μm or more and 10 μm or less and is more preferably 4 μm or more and 8 μm or less.

The above-described average diameters and particle diameter distribution indices of the toner particles are measured using "COULTER MULTISIZER II" (produced by Beckman Coulter, Inc.) with an electrolyte "ISOTON-II" (produced by Beckman Coulter, Inc.) in the following manner.

A sample to be measured (0.5 mg or more and 50 mg or less) is added to 2 ml of a 5%-aqueous solution of a surfactant (e.g., sodium alkylbenzene sulfonate) that serves as a dispersant. The resulting mixture is added to 100 ml or more and 150 ml or less of an electrolyte.

The resulting electrolyte containing the sample suspended therein is subjected to a dispersion treatment for 1 minute using an ultrasonic disperser, and the distribution of the diameters of particles having a diameter of 2 μm or more and 60 μm or less is measured using COULTER MULTISIZER II with an aperture having a diameter of 100 μm. The number of the particles sampled is 50,000.

The particle diameter distribution measured is divided into a number of particle diameter ranges (i.e., channels). For each range, in ascending order in terms of particle diameter, the cumulative volume and the cumulative number are calculated and plotted to draw cumulative distribution curves. Particle diameters at which the cumulative volume and the cumulative number reach 16% are considered to be the volume particle diameter D16*v* and the number particle diameter D16*p*, respectively. Particle diameters at which the cumulative volume and the cumulative number reach 50% are considered to be the volume average particle diameter D50*v* and the number average particle diameter D50*p*, respectively. Particle diameters at which the cumulative volume and the cumulative number reach 84% are considered to be the volume particle diameter D84*v* and the number particle diameter D84*p*, respectively.

Using the volume particle diameters and number particle diameters measured, the volume particle size distribution index (GSDv) is calculated as $(D84v/D16v)^{1/2}$ and the number particle size distribution index (GSDp) is calculated as $(D84p/D16p)^{1/2}$.

The toner particles preferably have an average circularity of 0.94 or more and 1.00 or less. The average circularity of the toner particles is more preferably 0.95 or more and 0.98 or less.

The average circularity of the toner particles is determined as [Equivalent circle perimeter]/[Perimeter] (i.e., [Perimeter of a circle having the same projection area as the particles]/[Perimeter of the projection image of the particles]. Specifically, the average circularity of the toner particles is determined by the following method.

The toner particles to be measured are sampled by suction so as to form a flat stream. A static image of the particles is taken by instantaneously flashing a strobe light. The image of the particles is analyzed with a flow particle image analyzer "FPIA-3000" produced by Sysmex Corporation. The number of samples used for determining the average circularity of the toner particles is 3,500.

In the case where the toner includes an external additive, the toner (i.e., the developer) to be measured is dispersed in water containing a surfactant and then subjected to an ultrasonic wave treatment in order to remove the external additive from the toner particles.

First Silica Particles

The toner according to the exemplary embodiment includes silica particles having a number average particle size of 110 nm or more and 130 nm or less, a large-diameter-side number particle size distribution index (upper GSDp) of less than 1.080, and an average circularity of 0.94 or more and 0.98 or less, wherein 80 number % or more of the silica particles have a circularity of 0.92 or more. Hereinafter, such silica particles are referred to as "first silica particles".

The specific image forming apparatus according to the exemplary embodiment includes a toner that includes the first silica particles as external additive particles. This may reduce the inconsistency in low-temperature fixability.

The number average particle size of the first silica particles is 110 nm or more and 130 nm or less. The number average particle size of the first silica particles is preferably 113 nm or more and 127 nm or less and is more preferably 115 nm or more and 125 nm or less in order to further reduce the inconsistency in low-temperature fixability.

The method for controlling the number average particle size of the first silica particles to fall within the above range is not limited. The number average particle size of the first silica particles may be controlled by, for example, using sol gel silica particles as first silica particles and adjusting the temperature at which an alkali catalyst and tetraalkoxysilane are mixed in the production of the sol gel silica particles or the amount of time during which the reaction is conducted. Alternatively, the concentrations of the alkali catalyst and tetraalkoxysilane may be adjusted.

The large-diameter-side number particle size distribution index (upper GSDp) of the first silica particles is less than 1.080. The upper GSDp of the first silica particles is preferably 1.077 or less and is more preferably less than 1.075 in order to further reduce the inconsistency in low-temperature fixability.

The small-diameter-side number particle size distribution index (lower GSDp) of the first silica particles is preferably less than 1.080 and is more preferably 1.075 or less in order to further reduce the inconsistency in low-temperature fixability.

The method for controlling the upper GSDp and lower GSDp of the first silica particles to fall within the above ranges is not limited. The upper GSDp and lower GSDp of the first silica particles may be controlled by, for example, using sol gel silica particles as first silica particles and adjusting the temperature at which an alkali catalyst and tetraalkoxysilane are mixed in the production of the sol gel silica particles or the amount of time during which the reaction is conducted. Alternatively, the concentrations of the alkali catalyst and tetraalkoxysilane may be adjusted.

The number average particle size, the upper GSDp, and the lower GSDp of the first silica particles are determined in the following manner.

(1) The toner is dispersed in methanol. After the resulting dispersion liquid has been stirred at room temperature (23° C.), the dispersion liquid is subjected to an ultrasonic bath in order to separate the external additive from the toner. Subsequently, centrifugal separation is performed to precipitate toner particles and collect a dispersion liquid containing the external additive dispersed therein. Then, methanol is removed by distillation and the external additive is extracted.

(2) The external additive is dispersed on the surface of the resin particle having a volume average particle size of 100 μm (polyester particles, weight average molecular weight Mw: 50,000).

(3) The resin particle on which the external additive is dispersed is observed with a scanning electron microscope (SEM) "S-4800" produced by Hitachi High-Technologies Corporation equipped with an energy dispersive X-ray (EDX) analyzer "EMAX Evolution X-Max 80=2" produced by HORIBA, Ltd. An image of the external additive is taken at a 40,000-fold magnification. Then, by EDX analysis, on the basis of the presence of Si, 300 or more primary particles of silica are identified in one field of view. The SEM observation is conducted with an accelerating voltage of 15 kV, an emission current of 20 μA, and a working distance (WD) of 15 mm. The EDX analysis is conducted under the same conditions as above for a detection time of 60 minutes.

(4) The resulting image is captured into an image processor "LUZEXIII" produced by NIRECO CORPORATION. The area of each particle is measured by image analysis.

(5) The size of each silica particle is calculated on the basis of the area calculated above in terms of equivalent circle diameter.

(6) 100 silica particles having an equivalent circle diameter of 80 nm or more are selected.

For the selected silica particles, a cumulative distribution curve is drawn in ascending order in terms of equivalent circle diameter. The particle size at which the cumulative number reaches 50% is considered the number average particle size of the first silica particles.

For the selected silica particles, a cumulative distribution curve is drawn in ascending order in terms of equivalent circle diameter. The particle size at which the cumulative number reaches 16% is considered the number particle size D16*p*. The particle size at which the cumulative number reaches 50% is considered the number average particle size D50*p*. The particle size at which the cumulative number reaches 84% is considered the number particle size D84*p*. The large-diameter-side number particle size distribution index (upper GSDp) is calculated as $(D84p/D50p)^{1/2}$. The small-diameter-side number particle size distribution index (lower GSDp) is calculated as $(D50p/D16p)^{1/2}$.

The average circularity of the first silica particles is 0.94 or more and 0.98 or less. The average circularity of the first silica particles is preferably 0.945 or more and 0.975 or less and is more preferably 0.950 or more and 0.970 or less in order to further reduce the inconsistency in low-temperature fixability.

The method for controlling the average circularity of the first silica particles to fall within the above range is not limited. The average circularity of the first silica particles may be controlled by, for example, using sol gel silica particles as first silica particles and adjusting the amount of time during which the reaction is conducted when an alkali catalyst and tetraalkoxysilane are mixed in the production of the sol gel silica particles. Alternatively, the concentration of the alkali catalyst may be adjusted.

The proportion of the first silica particles having a circularity of 0.92 or more is 80 number % or more. The proportion of the first silica particles having a circularity of 0.92 or more is preferably 85 number % or more and is more preferably 87 number % or more in order to further reduce the inconsistency in low-temperature fixability.

The method for controlling the proportion of the first silica particles having a circularity of 0.92 or more to fall within the above range is not limited. The proportion of the first silica particles having a circularity of 0.92 or more may be controlled by, for example, using sol gel silica particles as first silica particles and adjusting the temperature at which an alkali catalyst and tetraalkoxysilane are mixed in the production of the sol gel silica particles.

The average circularity of the first silica particles and the proportion of the first silica particles having a circularity of 0.92 or more are determined in the following manner.

The circularity of each of the 100 silica particles selected in the measurement of the number average particle size of the first silica particles, which is described above, is calculated using Formula (1) below. The circularity at which the frequency calculated in ascending order in terms of circularity reaches 50% is considered the average circularity of the first silica particles.

$$\text{Circularity}=4\pi\times(A/I^2) \quad (1)$$

where I represents the perimeter of a primary particle on the image; and A represents the projected area of the primary particle on the image.

The number proportion of silica particles having a circularity of 0.92 or more in the 100 silica particles used in the calculation of average circularity is considered the number proportion of the first silica particles having a circularity of 0.92 or more.

The degree of hydrophobicity of the first silica particles is preferably 50% or more and 80% or less, is more preferably 50% or more and 75% or less, and is further preferably 50% or more and 70% or less in order to further reduce the inconsistency in low-temperature fixability.

The method for controlling the degree of hydrophobicity of the first silica particles to fall within the above range is not limited. The degree of hydrophobicity of the first silica particles may be controlled by, for example, using sol gel silica particles as first silica particles and, in the production of the sol gel silica particles, subjecting the surfaces of the silica particles to a hydrophobic treatment using a hydrophobizing agent in the presence of supercritical carbon dioxide.

The degree of hydrophobicity of the first silica particles is determined in the following manner.

To 50 ml of ion-exchange water, 0.2% by mass of the sample, that is, the silica particles, is added. While the resulting mixture is stirred with a magnetic stirrer, methanol is added dropwise from a buret to the mixture. The mass fraction (%) of methanol in the methanol-ion exchange water mixed solution (=Amount of methanol added/[Amount of methanol added+Amount of ion-exchange water]) measured at the endpoint at which the whole amount of the sample settles in the solution is considered the degree of hydrophobicity (%).

The first silica particles may be any particles composed primarily of silica, that is, $SiO_2$, and may be either crystalline or amorphous. The first silica particles may be particles produced using a silicon compound, such as water glass or alkoxysilane, as a raw material and may be particles produced by pulverizing quartz. Examples of the first silica particles include sol gel silica particles; aqueous colloidal silica particles; alcoholic silica particles; fumed silica particles produced by a gas phase method or the like; and fused silica particles. Among the above silica particles, sol gel silica particles are preferably included in the first silica particles.

Sol gel silica particles may be produced by, for example, the following method. Tetraalkoxysilane (e.g., TMOS) is added dropwise to an alkali catalyst solution containing an alcohol compound and ammonia water to cause hydrolysis and condensation of tetraalkoxysilane and form a suspension containing sol gel silica particles. The solvent is removed from the suspension to obtain particulate matter. The particulate matter is dried to form sol gel silica particles.

The first silica particles may be silica particles hydrophobized with a hydrophobizing agent.

Examples of the hydrophobizing agent include publicly known organic silicon compounds including an alkyl group, such as a methyl group, an ethyl group, a propyl group, or a butyl group. Specific examples thereof include an alkoxysilane compound, a siloxane compound, and a silazane compound. Among these, at least one of the siloxane compound and the silazane compound is preferably included in the hydrophobizing agent. The hydrophobizing agents may be used alone or in combination of two or more.

Examples of the siloxane compound include a silicone oil and a silicone resin. The silicone oil may include a dimethyl silicone oil. The above siloxane compounds may be used alone or in combination of two or more.

Examples of the silazane compound include hexamethyldisilazane and tetramethyldisilazane. In particular, hexamethyldisilazane (HMDS) is preferably included in the silazane compound. The above silazane compounds may be used alone or in combination of two or more.

The amount of the hydrophobizing agent, such as the silazane compound, deposited on the surfaces of the first silica particles is preferably 0.01% by mass or more and 5% by mass or less, is more preferably 0.05% by mass or more and 3% by mass or less, and is further preferably 0.10% by mass or more and 2% by mass or less of the amount of the first silica particles in order to increase the degree of hydrophobicity of the first silica particles.

For performing the hydrophobic treatment of the first silica particles with the hydrophobizing agent, for example, the following methods may be used: a method in which the hydrophobizing agent is dissolved in supercritical carbon dioxide and thereby applied to the surfaces of the silica particles; a method in which a solution containing the hydrophobizing agent and a solvent in which the hydrophobizing agent is soluble is applied to the surfaces of the silica particles by spraying, coating, or the like in the atmosphere in order to apply the hydrophobizing agent onto the surfaces of the silica particles; and a method in which a solution containing the hydrophobizing agent and a solvent in which the hydrophobizing agent is soluble is added to a silica particle dispersion liquid in the atmosphere and, after holding has been performed, the mixed solution of the silica particle dispersion liquid and the above solution is dried.

Other External Additive

The toner according to the exemplary embodiment may further include an external additive other than the first silica particles. Hereinafter, such an external additive is referred to simply as "another external additive". Examples of the other external additive include inorganic oxide particles. Examples of the inorganic oxide particles include $SiO_2$ particles, $TiO_2$ particles, $Al_2O_3$ particles, CuO particles, ZnO particles, $SnO_2$ particles, $CeO_2$ particles, $Fe_2O_3$ particles, MgO particles, BaO particles, CaO particles, $K_2O$ particles, $Na_2O$ particles, $ZrO_2$ particles, $CaO.SiO_2$ particles, $K_2O.(TiO_2)_n$ particles, $Al_2O_3.2SiO_2$ particles, $CaCO_3$ particles, $MgCO_3$ particles, $BaSO_4$ particles, and $MgSO_4$ particles. Among the above inorganic oxide particles, $TiO_2$ and $SiO_2$ particles, that is, titania particles and silica particles (hereinafter, referred to as "second silica particles"), are preferably used.

The number average particle size of the inorganic oxide particles is preferably 5 nm or more and 50 nm or less and is more preferably 10 nm or more and 40 nm or less in order to further reduce the inconsistency in low-temperature fixability.

The number average particle size of the inorganic oxide particles is determined in the following manner.

(1) The toner is dispersed in methanol. After the resulting dispersion liquid has been stirred at room temperature (23° C.), the dispersion liquid is subjected to an ultrasonic bath in order to separate the external additive from the toner. Subsequently, centrifugal separation is performed to precipitate toner particles and collect a dispersion liquid containing the external additive dispersed therein. Then, methanol is removed by distillation and the external additive is extracted.

(2) The external additive is dispersed in resin particles having a volume average particle size of 100 μm (polyester particles, weight average molecular weight Mw: 50,000).

(3) The resin particles in which the external additive is dispersed are observed with a scanning electron microscope (SEM) "S-4800" produced by Hitachi High-Technologies Corporation equipped with an energy dispersive X-ray (EDX) analyzer "EMAX Evolution X-Max 80=$^2$" produced by HORIBA, Ltd. An image of the external additive is taken at a 40,000-fold magnification. Then, by EDX analysis, on the basis of the presence of the atom (e.g., Si or Ti) included in the inorganic oxide particles, 300 or more primary particles of inorganic oxide particles are identified in one field of view. The SEM observation is conducted with an accelerating voltage of 15 kV, an emission current of 20 μA, and a WD of 15 mm. The EDX analysis is conducted under the same conditions as above for a detection time of 60 minutes.

(4) The resulting image is captured into an image processor "LUZEXIII" produced by NIRECO CORPORATION. The area of each particle is measured by image analysis.

(5) The size of each inorganic oxide particle is calculated on the basis of the area calculated above in terms of equivalent circle diameter.

(6) 100 inorganic oxide particles having an equivalent circle diameter of less than 80 nm are selected. For the selected inorganic oxide particles, a cumulative distribution curve is drawn in ascending order in terms of equivalent circle diameter. The particle size at which the cumulative number reaches 50% is considered the number average particle size of the inorganic oxide particles.

The surfaces of the inorganic oxide particles used as an external additive may be subjected to a hydrophobic treatment. The hydrophobic treatment is performed by, for example, immersing the inorganic oxide particles in a hydrophobizing agent. Examples of the hydrophobizing agent include, but are not limited to, a silane coupling agent, a silicone oil, a titanate coupling agent, and aluminum coupling agent. These hydrophobizing agents may be used alone or in combination of two or more.

The amount of the hydrophobizing agent is commonly, for example, 1 part by mass or more and 10 parts by mass or less relative to 100 parts by mass of the inorganic oxide particles.

Examples of the external additive particles include particles of a resin, such as polystyrene, polymethyl methacrylate (PMMA), or a melamine resin; and particles of a cleaning lubricant, such as a fluorine-contained resin.

The amount of the other external additive used is preferably, for example, 0.01% by mass or more and 5% by mass or less and is more preferably 0.01% by mass or more and 2.0% by mass or less of the amount of the toner particles.

Lubricant Particles

In the case where a lubricant is supplied from the developer (i.e., the toner included in the developer) included in the developing device 18 to the photosensitive member 12, that is, in the case where the developing device 18 serves also as a lubricant supplying member, the toner further includes a particulate lubricant (hereinafter, referred to as "lubricant particles") as external additive particles.

The volume average size of the lubricant particles may be 0.8 times or more and 1.2 times or less the volume average size of the toner particles. Specifically, the volume average size of the lubricant particles is preferably 0.3 μm or more and 8 μm or less and is more preferably 0.5 μm or more and 5.0 μm or less.

The volume average size of the lubricant particles is measured by the following method. First, the toner to be measured is observed with a scanning electron microscope (SEM). The equivalent circle diameter of each of the 100 lubricant particles that are to be measured is determined by image analysis. For the 100 lubricant particles, a cumulative volume distribution curve is drawn in ascending order in terms of equivalent circle diameter. The equivalent circle diameter at which the cumulative number reaches 50% (i.e., the equivalent circle diameter of the 50th particle) is considered to be volume average particle size. In the image analysis for determining the equivalent circle diameters the 100 lubricant particles that are to be measured, a two-dimensional image is captured with an analysis device "ERA-8900" produced by Elionix Inc. with a 10,000-fold magnification, and the projected area of each of the 100 lubricant particles is calculated with an image analysis software "WINROOF" produced by MITANI CORPORATION at 0.010000 μm/pixel. The equivalent circle diameter of each lubricant particle is calculated using the following formula:

Equivalent circle diameter=$2\sqrt{(\text{Projected area}/\pi)}$ The amount of the lubricant particles deposited on the surface of the toner particles is preferably 0.02 parts by mass or more and 5 parts by mass or less, is more preferably 0.05 parts by mass or more and 3.0 parts by mass or less, and is further preferably 0.08 parts by mass or more and 1.0 parts by mass or less relative to 100 parts by mass of the toner particles.

Method for Producing Toner

A method for producing the toner according to the exemplary embodiment is described below.

The toner according to the exemplary embodiment is produced by, after the preparation of the toner particles, depositing an external additive on the surfaces of the toner particles.

The toner particles may be prepared by any dry process, such as knead pulverization, or any wet process, such as aggregation coalescence, suspension polymerization, or dissolution suspension. However, the method for preparing the toner particles is not limited thereto, and any suitable method known in the related art may be used.

The toner according to the exemplary embodiment is produced by, for example, adding an external additive to the dried toner particles and mixing the resulting toner particles using a V-blender, a HENSCHEL mixer, a Lodige mixer, or the like. Optionally, coarse toner particles may be removed using a vibrating screen classifier, a wind screen classifier, or the like.

Carrier

The type of the carrier is not limited, and any suitable carrier known in the related art may be used. Examples of the carrier include a coated carrier prepared by coating the surfaces of cores including magnetic powder particles with a coat resin; a magnetic-powder-dispersed carrier prepared by dispersing and mixing magnetic powder particles in a matrix resin; and a resin impregnated carrier prepared by impregnating a porous magnetic powder with a resin.

The magnetic-powder-dispersed carrier and the resin impregnated carrier may also be prepared by coating the surfaces of particles constituting the carrier, that is, core particles, with a coat resin.

Examples of the magnetic powder include powders of magnetic metals, such as iron, nickel, and cobalt; and powders of magnetic oxides, such as ferrite and magnetite.

Examples of the coat resin and the matrix resin include polyethylene, polypropylene, polystyrene, poly(vinyl acetate), poly(vinyl alcohol), poly(vinyl butyral), poly(vinyl chloride), poly(vinyl ether), poly(vinyl ketone), a vinyl chloride-vinyl acetate copolymer, a styrene-acrylic acid ester copolymer, a straight silicone resin including an organosiloxane bond and the modified products thereof, a fluorine resin, polyester, polycarbonate, a phenolic resin, and an epoxy resin. The coat resin and the matrix resin may optionally include additives, such as conductive particles.

Examples of the conductive particles include particles of metals, such as gold, silver, and copper; and particles of carbon black, titanium oxide, zinc oxide, tin oxide, barium sulfate, aluminum borate, and potassium titanate.

The surfaces of the cores can be coated with a coat resin by, for example, using a coating layer forming solution prepared by dissolving the coat resin and, as needed, various types of additives in a suitable solvent. The type of the solvent is not limited and may be selected with consideration of the type of the coat resin used, ease of applying the coating layer forming solution, and the like. Specific examples of a method for coating the surfaces of the cores with the coat resin include an immersion method in which the cores are immersed in the coating layer forming solution; a spray method in which the coating layer forming solution is sprayed onto the surfaces of the cores; a fluidized bed method in which the coating layer forming solution is sprayed onto the surfaces of the cores while the cores are floated using flowing air; and a kneader coater method in which the cores of the carrier are mixed with the coating layer forming solution in a kneader coater and subsequently the solvent is removed.

The mixing ratio (i.e., mass ratio) of the toner to the carrier in the two-component developer is preferably toner: carrier=1:100 to 30:100 and is more preferably 3:100 to 20:100.

Examples

Examples of the exemplary embodiment of the present disclosure are described below. The exemplary embodiment of the present disclosure is not limited to Examples below. Hereinafter, the terms "part" and "%" are all on a mass basis unless otherwise specified.

Preparation of First Silica Particles

Preparation of Silica Particle Dispersion Liquid (1)

To a glass reaction container equipped with a stirrer, a dropping nozzle, and a thermometer, 300 parts of methanol and 70 parts of 10% ammonia water are added. The resulting mixture is stirred to form an alkali catalyst solution. After the temperature of the alkali catalyst solution has been adjusted to be 30° C. (hereinafter, this temperature is referred to as "addition start temperature"), 185 parts of tetramethoxysilane and 50 parts of 8% ammonia water are simultaneously added dropwise to the alkali catalyst solution while stirring is performed. Hereby, a hydrophilic silica particle dispersion liquid (solid content: 12%) is prepared. The amount of time during which tetramethoxysilane and ammonia water are added dropwise to the alkali catalyst solution (hereinafter, referred to as "addition time") is 30 minutes. The silica particle dispersion liquid is concentrated to have a solid content of 40% with a rotary filter "R-Fine" produced by Kotobuki Industries Co., Ltd. This concentrated dispersion liquid is used as a silica particle dispersion liquid (1).

Preparation of Silica Particle Dispersion Liquids (2) to (8) and (c1) to (c6)

Silica particle dispersion liquids (2) to (8) and (c1) to (c6) are prepared as in the preparation of the silica particle dispersion liquid (1), except that the conditions under which the alkali catalyst solution is prepared (i.e., the amounts of the methanol and ammonia water included in the alkali catalyst solution and the concentration of the ammonia water) and the conditions under which the silica particles are formed (i.e., the amount of tetramethoxysilane (TMOS) added to the alkali catalyst solution, the concentration of the ammonia water, the total amount of the ammonia water added, and the addition time and the addition start temperature of TMOS and ammonia water) are changed as described in Table 1.

Preparation of Surface Treated Silica Particles (S1)

Using the silica particle dispersion liquid (1), the surfaces of silica particles are treated with a siloxane compound in a supercritical carbon dioxide atmosphere in the following manner. The surface treatment is performed using an apparatus equipped with a carbon dioxide cylinder, a carbon dioxide pump, an entrainer pump, an autoclave with a stirrer (capacity: 500 ml), and a pressure valve.

First, 300 parts of the silica particle dispersion liquid (1) is charged into the autoclave with a stirrer (capacity: 500 ml), and the stirrer is rotated at 100 rpm. Subsequently, liquid carbon dioxide is injected into the autoclave. While the temperature is increased with a heater, the pressure is increased with the carbon dioxide pump to bring the inside of the autoclave into a supercritical state of 150° C. and 15 MPa. Subsequently, while the pressure inside the autoclave is maintained to be 15 MPa with the pressure valve, supercritical carbon dioxide is passed through the autoclave with the carbon dioxide pump in order to remove methanol and water from the silica particle dispersion liquid (1) (solvent removal step). Hereby, silica particles (i.e., untreated silica particles) are prepared.

The flow of supercritical carbon dioxide is stopped when the amount of the supercritical carbon dioxide passed (cumulative amount; in terms of the amount of carbon dioxide in the standard condition) reaches 900 parts.

Then, while the temperature is maintained to be 150° C. with a heater and the pressure is maintained to be 15 MPa with the carbon dioxide pump in order to maintain the supercritical state of carbon dioxide inside the autoclave, a treatment agent solution prepared by dissolving 0.3 parts of a dimethyl silicone oil (DSO) "KF-96" produced by Shin-Etsu Chemical Co., Ltd. having a viscosity of 10,000 cSt, which is a siloxane compound, in 20 parts of hexamethyldisilazane (HMDS) produced by Yuki Gosei Kogyo Co., Ltd., which is a hydrophobizing agent, relative to 100 parts of the silica particles (i.e., untreated silica particles) is injected into the autoclave with the entrainer pump. While the resulting mixture is stirred, the mixture is caused to react at 180° C. for 20 minutes. Subsequently, supercritical carbon dioxide is again passed through the autocrave to remove excess treatment agent solution. Subsequently, the stirring is stopped. The pressure valve is opened to reduce the pressure inside the autoclave to atmospheric pressure. The temperature is reduced to room temperature (25° C.).

In the above-described manner, the solvent removal step and the surface treatment using HMDS and DSO are performed to prepare surface treated silica particles (S1).

Preparation of Surface Treated Silica Particles (S2) to (S8) and (cS1) to (cS6)

Surface treated silica particles (S2) to (S8) and (cS1) to (cS6) are prepared as in the preparation of the surface treated silica particles (S1).

Preparation of Surface Treated Silica Particles (cS7) and (cS8)

Surface treated silica particles (cS7) are prepared as described in Paragraphs [0051] to [0053] of Japanese Laid Open Patent Application Publication No. 2008-174430. Surface treated silica particles (cS8) are prepared as described in Paragraph [0019] of Japanese Laid Open Patent Application Publication No. 2001-194824.

TABLE 1

| | Alkali catalyst solution | | | Silica particle formation conditions | | | | |
|---|---|---|---|---|---|---|---|---|
| | | | | Total amount of TMOS added | Ammonia water | | | |
| | | Ammonia water | | | | Total amount added | Addition time | Addition start temperature |
| Silica particles | Methanol (part) | Concentration (%) | Amount (part) | (part) | Concentration (%) | (part) | (minute) | (° C.) |
| S1 | 300 | 10 | 70 | 185 | 8 | 50 | 30 | 30 |
| S2 | 300 | 10 | 70 | 185 | 8 | 50 | 30 | 35 |
| S3 | 300 | 10 | 70 | 185 | 8 | 45 | 30 | 30 |
| S4 | 300 | 10 | 75 | 185 | 8 | 50 | 30 | 30 |
| S5 | 300 | 10 | 65 | 185 | 8 | 50 | 50 | 30 |
| S6 | 300 | 10 | 65 | 170 | 8 | 50 | 20 | 30 |
| S7 | 300 | 10 | 70 | 247 | 8 | 67 | 55 | 40 |
| S8 | 300 | 10 | 70 | 123 | 8 | 30 | 18 | 30 |
| cS1 | 300 | 10 | 70 | 185 | 8 | 50 | 30 | 45 |
| cS2 | 300 | 10 | 50 | 185 | 8 | 50 | 30 | 20 |
| cS3 | 300 | 10 | 110 | 185 | 8 | 50 | 30 | 30 |
| cS4 | 300 | 10 | 46 | 120 | 8 | 30 | 30 | 30 |
| cS5 | 300 | 10 | 70 | 340 | 8 | 92 | 55 | 30 |
| cS6 | 300 | 10 | 70 | 120 | 8 | 30 | 20 | 30 |

Preparation of Polyester Resin Particle Dispersion Liquids

Preparation of Amorphous Polyester Resin Particle Dispersion Liquid (A1)

Terephthalic acid: 70 parts

Fumaric acid: 30 parts

Ethylene glycol: 45 parts 1,5-Pentanediol: 46 parts

Into a flask equipped with a stirring device, a nitrogen introducing tube, a temperature sensor, and a fractionating column, the above materials are charged. Under a nitrogen stream, the temperature is increased to 220° C. over 1 hour, and 1 part of titanium tetraethoxide relative to 100 parts of the total amount of the above materials is added to the flask. While the product water is removed by distillation, the temperature is increased to 240° C. over 0.5 hours and dehydration condensation is continued for 1 hour at 240° C. Subsequently, the product of the reaction is cooled. Hereby, a polyester resin having a weight average molecular weight of 9,500 and a glass transition temperature of 62° C. is synthesized.

Into a container equipped with a temperature control unit and a nitrogen purging unit, 40 parts of ethyl acetate and 25 parts of 2-butanol are charged to form a mixed solvent. To the mixed solvent, 100 parts of a polyester resin is gradually added and dissolved in the mixed solvent. To the resulting solution, a 10% aqueous ammonia solution is added in an amount 3 times by mole with respect to the acid value of the resin. The resulting mixture is stirred for 30 minutes. Then, the inside of the container is purged with dry nitrogen. While the temperature is maintained to be 40° C. and the liquid mixture is stirred, 400 parts of ion-exchange water is added dropwise to the container at a rate of 2 part/min in order to perform emulsification. After the addition of ion-exchange water has been terminated, the resulting emulsion is cooled to 25° C. Hereby, a resin particle dispersion liquid that includes resin particles having a volume average particle size of 200 nm dispersed therein is prepared. Ion-exchange water is added to the resin particle dispersion liquid to adjust the solid content in the dispersion liquid to be 20%. Hereby, an amorphous polyester resin particle dispersion liquid (A1) is prepared. Preparation of Crystalline Polyester Resin Particle Dispersion Liquid (C1)

1,10-Decanedicarboxylic acid: 98 parts

Sodium dimethyl-5-sulfonate isophthalate: 24 parts 1,9-Nonanediol: 100 parts

Dibutyltin oxide (catalyst): 0.3 parts

The above components are charged into a three-necked flask dried by heating. Subsequently, the pressure is reduced to replace the atmosphere inside the container with an inert atmosphere with a nitrogen gas. The resulting mixture is stirred by mechanical stirring and caused to reflux at 180° C. for 5 hours. Then, the temperature is gradually increased to 230° C. under reduced pressure and stirring is performed for 2 hours. When the mixture becomes viscous, air cooling is performed and the reaction is stopped. Hereby, a crystalline polyester resin is prepared. The weight average molecular weight (Mw) of the crystalline polyester resin measured in terms of polystyrene is 9,700. The crystalline polyester resin has a melting temperature of 78° C.

Then, 90 parts of the crystalline polyester resin, 1.8 parts of an anionic surfactant "NEOGEN RK" produced by DKS Co. Ltd., and 210 parts of ion-exchange water are heated to 100° C. and dispersed with ULTRA-TURRAX T50 produced by IKA. Subsequently, a dispersion treatment is performed for 1 hour using a pressure-discharge Gaulin homogenizer. Hereby, a crystalline polyester resin particle dispersion liquid (C1) having a volume average particle size of 200 nm and a solid content of 20% is prepared.

Preparation of Release Agent Particle Dispersion Liquid

Paraffin wax "HNP-9" produced by Nippon Seiro Co., Ltd.: 100 parts

Anionic surfactant "NEOGEN RK" produced by Dai-ichi Kogyo Seiyaku Co., Ltd.: 1 part Ion-exchange water: 350 parts The above materials are mixed with one another and heated to 100° C. The resulting mixture is dispersed with a homogenizer "ULTRA-TURRAX T50" produced by IKA and then further dispersed with a Manton Gaulin high-pressure homogenizer produced by Gaulin. Hereby, a release agent particle dispersion liquid (solid content: 20%) in which release agent particles having a volume average particle size of 200 nm are dispersed is prepared.

Preparation of Black Colored Particle Dispersion Liquid

Carbon black "REGAL330" produced by Cabot Corporation: 50 parts

Anionic surfactant "NEOGEN RK" produced by DKS Co. Ltd.: 5 parts

Ion-exchange water: 192.9 parts

The above components are mixed with one another, and the resulting mixture is subjected to ULTIMIZER produced by Sugino Machine Limited at 240 MPa for 10 minutes. Hereby, a black colored particle dispersion liquid (solid content: 20%) is prepared.

Preparation of Toner Particles (A1)

Ion-exchange water: 200 parts

Amorphous polyester resin particle dispersion liquid (A1): 150 parts

Crystalline polyester resin particle dispersion liquid (C1): 10 parts

Black colored particle dispersion liquid: 15 parts

Release agent particle dispersion liquid: 10 parts

Anionic surfactant (TAYCAPOWER): 2.8 parts

The above materials are charged into a round-bottom flask made of stainless steel. After pH has been adjusted to be 3.5 by addition of 0.1 N nitric acid, an aqueous polyaluminum chloride (PAC) solution prepared by dissolving 2.0 parts of PAC (30% powder produced by Oji Paper Co., Ltd.) in 30 parts of ion-exchange water is added to the flask. After dispersion has been performed with a homogenizer "ULTRA-TURRAX T50" produced by IKA at 30° C., the temperature is increased to 45° C. in a heating oil bath. Then, holding is performed until the volume average particle size reaches 4.8 μm. Subsequently, 60 parts of the amorphous polyester resin particle dispersion liquid (A1) is added to the flask and holding is performed for 30 minutes. When the volume average particle size reaches 5.2 μm, another 60 parts of the amorphous polyester resin particle dispersion liquid (A1) is added to the flask and holding is performed for 30 minutes. Then, 20 parts of a 10% aqueous solution of nitrilotriacetic acid (NTA) metal salt "CHELEST 70" produced by Chelest Corporation is added to the flask. Subsequently, the pH is adjusted to be 9.0 using a 1 N aqueous sodium hydroxide solution. Then, 1.0 parts of an anion activator "TAYCAPOWER" is added to the flask. While stirring is continued, the temperature is increased to 85° C. and then holding is performed for 5 hours. Subsequently, the temperature is reduced to 20° C. at a rate of 20° C./min. Then, filtration is performed. The resulting substance is sufficiently washed with ion-exchange water and dried to form toner particles (A1) having a volume average particle size of 6.0 μm.

Preparation of Toner (A1)

With 100 parts of the toner particles (A1), 1.5 parts of the first silica particles (S1) and 0.5 parts of titania particles having a number average particle size of 20 nm, which are inorganic oxide particles, are mixed. The resulting mixture is stirred with a sample mill at a rotation speed of 13,000 rpm for 30 seconds. Then, screening is performed with a vibration sieve having an opening of 45 μm. Hereby, a toner (A1) is prepared. Preparation of Toners (A2) to (A12) and (cA1) to (cA8)

le;.5qToners (A2) to (A12) and (cA1) to (cA8) are prepared as in the preparation of toner (A1), except that the type of the first silica particles used is changed as described in Table 2.

Preparation of Developers (A1) to (A12) and (cA1) to (cA8)

Into a V-blender, 10 parts of a specific one of the toners and 100 parts of the resin-coated carrier particles described below are charged. The resulting mixture is stirred for 20 minutes and then screened through a vibration sieve having an opening of 212 μm to form a developer.

Mn—Mg—Sr ferrite particles (average particle size: 40 μm): 100 parts

Toluene: 14 parts

Polymethyl methacrylate: 2 parts

Carbon black "VXC72" produced by Cabot Corporation: 0.12 parts

The above materials except the ferrite particles are mixed with glass beads (diameter 1 mm, in an amount equal to that of the toluene used). The resulting mixture is stirred with a sand mill produced by Kansai Paint Co., Ltd. at a rotation speed of 1,200 rpm for 30 minutes to form a dispersion liquid. The dispersion liquid and the ferrite particles are charged into a vacuum degassing kneader. While the resulting mixture is stirred, the pressure is reduced and drying is performed. Hereby, resin-coated carrier particles are prepared.

TABLE 2

| | | First silica particles | | | | | | |
|---|---|---|---|---|---|---|---|---|
| Toner particles | Developer | Type | Average circularity | Number average particle size Da (nm) | Upper GSDp | Lower GSDp | Proportion of silica particles having circularity of 0.92 or more (number %) | Degree of hydrophobicity (%) |
| cA1 | cA1 | cS1 | 0.958 | 120 | 1.090 | 1.041 | 85 | 64 |
| cA2 | cA2 | cS2 | 0.945 | 120 | 1.071 | 1.074 | 72 | 64 |
| cA3 | cA3 | cS3 | 0.981 | 120 | 1.022 | 1.028 | 95 | 64 |
| cA4 | cA4 | cS4 | 0.928 | 120 | 1.068 | 1.055 | 89 | 64 |
| cA5 | cA5 | cS5 | 0.958 | 140 | 1.029 | 1.033 | 94 | 64 |
| cA6 | cA6 | cS6 | 0.958 | 100 | 1.059 | 1.055 | 88 | 64 |
| cA7 | cA7 | cS7 | 0.950 | 120 | 1.072 | 1.049 | 72 | 64 |
| cA8 | cA8 | cS8 | 0.942 | 115 | 1.093 | 1.037 | 82 | 58 |
| A1 | A1 | S1 | 0.958 | 120 | 1.058 | 1.042 | 90 | 64 |
| A2 | A2 | S2 | 0.958 | 120 | 1.077 | 1.071 | 87 | 64 |
| A3 | A3 | S3 | 0.958 | 120 | 1.065 | 1.081 | 88 | 64 |
| A4 | A4 | S4 | 0.974 | 120 | 1.025 | 1.028 | 94 | 64 |
| AS | AS | S5 | 0.941 | 120 | 1.032 | 1.066 | 90 | 64 |
| A6 | A6 | S6 | 0.958 | 120 | 1.046 | 1.039 | 84 | 64 |
| A7 | A7 | S7 | 0.964 | 128 | 1.068 | 1.060 | 98 | 64 |
| A8 | A8 | S8 | 0.950 | 112 | 1.061 | 1.074 | 89 | 64 |

Examples 1 to 28 and Comparative Examples 1 to 8

The image forming apparatuses (1) are prepared as described in Table 3.

Image Forming Apparatus (1): DH1 Method

As an image forming apparatus (1), an image forming apparatus that is a modification of "VERSANT 80 PRESS" produced by Fuji Xerox Co., Ltd. is prepared. This image forming apparatus has a structure analogous to that illustrated in FIG. 2. The image forming apparatus is modified to have a direct-heating fixing device that directly heats the contact region between the fixing belt and the pressurizing roller with a halogen lamp. The developer described in Table 3 is charged into the developing device of the image forming apparatus. A replenishment toner (i.e., a toner that is the same as the toner included in the developer) is charged into the toner cartridge.

Evaluation of Low-Temperature Fixability

Each of the image forming apparatuses prepared in Examples is evaluated in terms of low-temperature fixability.

A 20 cm×20 cm patch is formed on a J-paper (A4) at a toner deposition density of 4.0 g/m$^2$. This image is formed on 10 paper sheets under fixed conditions (process speed: 140 mm/sec, fusing temperature: 110° C.). The 1st, 5th, and 10th images are evaluated in terms of the following criteria. The average of the evaluation results of the 1st, 5th, and 10th images is used for the evaluation.

The following evaluation criteria are used. The evaluation grades of "A" and "B" are given to acceptable images.

A: No unevenness is present in the image.

B: Slight unevenness is present in the image.

C: Clear unevenness is present in the image.

D: White missing dots are present in the image.

TABLE 3

| | Developer | Silica particles | Evaluation Low-temperature fixability |
|---|---|---|---|
| Comparative example 1 | cA1 | cS1 | D |
| Comparative example 2 | cA2 | cS2 | C |
| Comparative example 3 | cA3 | cS3 | C |
| Comparative example 4 | cA4 | cS4 | C |
| Comparative example 5 | cA5 | cS5 | D |
| Comparative example 6 | cA6 | cS6 | C |
| Comparative example 7 | cA7 | cS7 | C |
| Comparative example 8 | cA8 | cS8 | C |
| Example 1 | A1 | S1 | A |
| Example 2 | A2 | S2 | B |
| Example 3 | A3 | S3 | B |
| Example 4 | A4 | S4 | B |
| Example 5 | A5 | S5 | A |
| Example 6 | A6 | S6 | B |
| Example 7 | A7 | S7 | B |
| Example 8 | A8 | S8 | B |

As described in Table 3, the image forming apparatuses prepared in Examples reduce the inconsistency in low-temperature fixability compared with the image forming apparatuses prepared in Comparative examples.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

an image holding member;

a charging unit that charges a surface of the image holding member;

an electrostatic image forming unit that forms an electrostatic image on the charged surface of the image holding member;

a developing unit that includes an electrostatic image developer that includes a toner and develops the electrostatic image formed on the surface of the image holding member with the electrostatic image developer to form a toner image;

a transfer unit that transfers the toner image onto a surface of a recording medium; and a fixing unit that fixes the toner image transferred on the surface of the recording medium to the recording medium, the fixing unit including a fixing belt arranged to contact with the toner image transferred on the surface of the recording medium, a rotatable body arranged to be in contact with an outer peripheral surface of the fixing belt so as to form a contact region between the rotatable body and the fixing belt, the rotatable body transporting the recording medium in the contact region by rotating together with the fixing belt, and a heat source that heats the contact region formed between the fixing belt and the rotatable body, the toner including toner particles, and silica particles having a number average particle size of 110 nm to 130 nm, a large-diameter-side number particle size distribution index (upper GSDp) of less than 1.080, and an average circularity of 0.94 to 0.98, wherein 80 number % or more of the silica particles have a circularity of 0.92 or more.

2. The image forming apparatus according to claim 1, wherein the silica particles have a large-diameter-side number particle size distribution index (upper GSDp) of 1.075 or less.

3. The image forming apparatus according to claim 1, wherein the silica particles have a small-diameter-side number particle size distribution index (lower GSDp) of 1.080 or less.

4. The image forming apparatus according to claim 1, wherein the silica particles have an average circularity of 0.95 to 0.97.

5. The image forming apparatus according to claim 1, wherein 85 number % or more of the silica particles have a circularity of 0.92 or more.

6. The image forming apparatus according to claim 1, wherein the toner further includes inorganic oxide particles having a number average particle size of 5 nm to 50 nm.

7. The image forming apparatus according to claim 6, wherein a ratio Da/Db of the number average particle size Da of the silica particles to the number average particle size Db of the inorganic oxide particles is 2.5 to 20.

8. The image forming apparatus according to claim 1, wherein the fixing unit includes a pressurizing member disposed on an inner peripheral surface of the fixing belt, the pressurizing member pressurizing the fixing belt in the contact region together with the rotatable body, and wherein the heat source is a heat source that heats the contact region with the pressurizing member interposed between the heat source and the contact region.

9. The image forming apparatus according to claim 8, wherein the heat source includes a halogen lamp.

10. The image forming apparatus according to claim 9, further comprising:

a reflective member that reflects heat emitted from the halogen lamp toward the contact region.

11. The image forming apparatus according to claim 10, further comprising:

a heat insulating member interposed between an edge of the reflective member and a portion of the inner peripheral surface of the fixing belt, the portion of the inner peripheral surface facing the edge.

12. The image forming apparatus according to claim 1, wherein the fixing unit further includes a pressing member disposed downstream of the contact region, the pressing member pressing the rotatable body from an inside of a space surrounded by the fixing belt.

13. The image forming apparatus according to claim 12, wherein the rotatable body includes an elastic layer disposed on a surface of the rotatable body, the surface being pressed together with the fixing belt.

14. The image forming apparatus according to claim 13, wherein the pressing member is arranged such that the elastic layer becomes elastically deformed.

15. The image forming apparatus according to claim 13, wherein the pressing member is arranged such that the elastic layer becomes elastically deformed locally on an exit side of the fixing unit.

16. The image forming apparatus according to claim 1, wherein the heat source includes a linear heating element.

17. The image forming apparatus according to claim 16, wherein the fixing unit includes a power supply unit that applies a pulsed current to the linear heating element.

18. The image forming apparatus according to claim 16, wherein the fixing unit further includes:

a sliding member arranged slidable together with the linear heating element;

a power supply unit that applies a pulsed current to the linear heating element; and a cooling unit that cools a fixed image formed by fixing the toner image transferred on the surface of the recording medium, and wherein the linear heating element heats the contact region with the sliding member interposed between the linear heating element and the contact region.

19. The image forming apparatus according to claim 1, wherein the fixing unit includes an electromagnetic induction heating device.

20. The image forming apparatus according to claim 19, wherein the electromagnetic induction heating device includes a metal layer disposed inside the fixing belt, the metal layer serving as a heat source.

* * * * *